US008658931B2

(12) United States Patent
Heller et al.

(10) Patent No.: US 8,658,931 B2
(45) Date of Patent: Feb. 25, 2014

(54) THREE PHASE VACUUM INTERRUPTER SWITCH FOR HIGH VOLTAGE DISTRIBUTION SYSTEMS

(75) Inventors: Carl Heller, Brea, CA (US); Kuang-Chien Hu, New Taipei (TW); Robert Sung, Irvine, CA (US); Patrick Lin, Brea, CA (US)

(73) Assignee: Impact Power, Inc., Irvine, CA (US)

( * ) Notice: Subject to any disclaimer, the term of this patent is extended or adjusted under 35 U.S.C. 154(b) by 288 days.

(21) Appl. No.: 13/087,321

(22) Filed: Apr. 14, 2011

(65) Prior Publication Data

US 2011/0253675 A1 Oct. 20, 2011

Related U.S. Application Data

(60) Provisional application No. 61/324,701, filed on Apr. 15, 2010.

(51) Int. Cl.
*H01H 33/666* (2006.01)

(52) U.S. Cl.
USPC ..... 218/120; 218/153; 218/10

(58) Field of Classification Search
USPC ..... 218/5, 7–10, 12, 118–120, 136–140
See application file for complete search history.

(56) References Cited

U.S. PATENT DOCUMENTS 3,038,980 A * 6/1962 Lee ..... 218/126
4,105,878 A * 8/1978 Date et al. ..... 218/10

OTHER PUBLICATIONS

"Protection and Control-Molded Vacuum Switches"; Elastimold; PG-PC-0107.

* cited by examiner

*Primary Examiner* — Amy Cohen Johnson
*Assistant Examiner* — Marina Fishman
(74) *Attorney, Agent, or Firm* — Robert A. Seldon

(57) ABSTRACT

A three-phase vacuum interrupter switch assembly for power distribution systems comprises an outer case having at least one window, a plurality of internal disconnect switch assemblies, and a plurality of vacuum interrupter bottle switch assemblies within the case. Each vacuum interrupter bottle switch is coupled in electrical series with a corresponding internal disconnect switch assembly. Because the open/closed state of a bottle switch is not directly observable owing to its sealed interior, a direct visible indication of the state of the three-phase vacuum interrupter switch assembly is provided by a visually detectable contact rod for each internal disconnect switch that is visible through the case window. To prevent potentially serious damage caused by arcing between the contacts of the internal disconnect switch, the internal disconnect switch is prevented from opening or closing when the bottle switches are closed. The case interior is preferably free of oil and/or $SF_6$ gas.

6 Claims, 38 Drawing Sheets

FIG. 39A
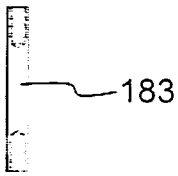
FIG. 39B
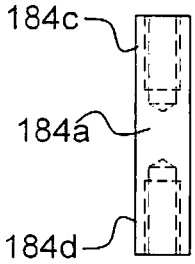
FIG. 39C
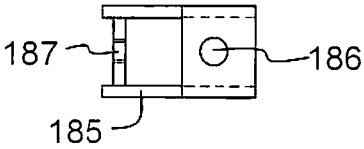
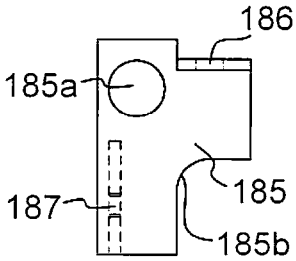
FIG. 39D
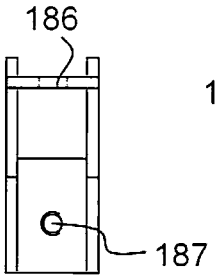
FIG. 39E
FIG. 39F
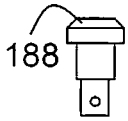
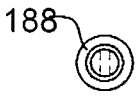
FIG. 39G
FIG. 39H
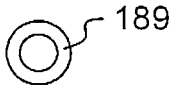
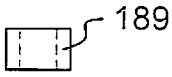
FIG. 39I
FIG. 39J
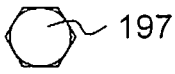
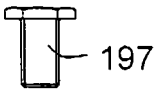
FIG. 39K
FIG. 39L
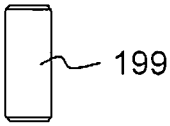
FIG. 39M
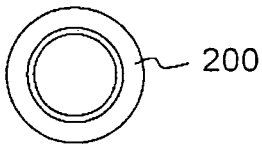
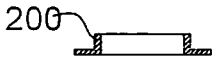
FIG. 39N

THREE PHASE VACUUM INTERRUPTER SWITCH FOR HIGH VOLTAGE DISTRIBUTION SYSTEMS

FIELD OF THE INVENTION

The present invention pertains to current interrupting switches for power distribution systems. More particularly, the present invention relates to vacuum interrupter switches for underground locations of three-phase four-wire power distribution systems.

BACKGROUND

Electric utility power distribution systems are frequently constructed underground for a variety of reasons ranging from objections to the above-ground aesthetics, the premium of above-ground space in dense urban locations, and safety concerns. Accordingly, power distribution systems heretofore constructed of poles, wires, and pole-mounted switches and transformers are being superseded and even replaced by underground systems in underground installations.

Whether used in overhead or underground locations within a power distribution system, the main function of current-interrupting switches is to isolate desired sections to allow for maintenance. While overhead space is relatively open and unrestricted, space in underground installations is at a premium. Underground installations (which are also referred to as "vaults") are relatively small and need to have enough space for all the necessary material, as well as enough room for lineman to safely work inside.

For many vaults, switch installation requires using an equipment access hole which may require lifting a heavy cover and can be costly. A switch that can fit through a maintenance hole (sometimes referred to as an "access hole" or a "manhole"), however, can be very cost effective. Many switches currently used in underground vaults contain oil or $SF_6$ gas as an electrical insulation medium in order to make the switch small. It is possible that a switch containing oil or $SF_6$ gas can be made small enough to fit through a maintenance hole; however, rising environmental and safety concerns discourage the use of oil and $SF_6$ gas, which can each be flammable and/or explosive while presenting environmental hazards when leakage occurs or when emissions are created. Thus, utility companies are trying to move away from switches with oil or $SF_6$ gas.

Three-phase vacuum switches have been manufactured under the Elastimold trademark by Thomas & Betts Corporation (Memphis, Tenn.) that fit through a maintenance hole, and utilize vacuum interrupter bottle switches as the current-interrupting switch. The vacuum interrupter bottle switches utilized in the Elastimold switches are molded inside a rubber housing and surrounded with a thin metal sheet. Vacuum interrupter bottle switches are manufactured so that the inside components cannot be seen. The only indication as to whether or not the switch is opened or closed is the position of an exterior handle which is not the most direct type of visible evidence one wishes to have when dealing with such high voltages and currents. It is not possible to determine whether the switch is truly open or closed because the movable contacts are hidden inside.

Three-phase vacuum switches have been developed to fit through a maintenance hole, and utilize vacuum interrupter switches as the current-interrupting switch. However, they do not incorporate a visible disconnect switch as a safety feature. It is not possible to determine whether a vacuum interrupter bottle switch is open or closed because the movable contacts associated with the switches are contained within the sealed body of the bottle.

SUMMARY OF THE INVENTION

The present invention pertains to vacuum interrupter switches designed to replace oil and $SF_6$ gas switch assemblies, while being compact enough to fit through a 30-inch diameter maintenance hole for use in underground three-phase four-wire power distribution systems.

A vacuum interrupter switch assembly constructed in accordance with the invention (hereinafter sometimes referred to simply as the "switch assembly") includes a direct visible indication of the vacuum interrupter switch assembly's open-circuited state, a configuration that minimizes the chances of death or injury to personnel and of a spark-induced fire or explosion owing to an attempted connection of the switch assembly to the electrical grid while in an incorrect switching state, and also provides a configuration that can close into and open under a bolted fault current without the container exploding. The term "bolted fault current" is recognized by those skilled in the art to denote the large short circuit current that can flow through the vacuum interrupter switch assembly when conductors at different potentials become connected, the magnitude of which can cause arcing between opening switch contacts.

Other objects, advantages and significant features of the invention will become apparent from the following detailed description, which, taken in conjunction with the annexed drawings, disclose a preferred embodiment of the invention.

It will be understood that orientations described in this specification, such as "up", "down", "top", "side" and the like, are relative, and are used for the purpose of describing an embodiment of the invention with respect to the drawings. Those of ordinary skill in the art will recognize that the orientation of the disclosed device can be varied in practice, and that the orientation used herein has been chosen for explanatory purposes only. Similarly, it will be recognized by those skilled in the art that the materials referred to herein, and particularly those identified by trademark, are examples of materials that meet the requirements and specifications mandated by safety concerns and by the use of the preferred switch assembly with electric power lines. Accordingly, other acceptable materials are within the scope of the invention whether known by generic names and/or other trademarks, or comprising other functionally equivalent material.

DESCRIPTION OF THE DRAWINGS

FIGS. 39A-N are illustrations of components of the vacuum interrupter bottle switch assembly operating mechanism of FIG. 27;

DETAILED DESCRIPTION OF THE PREFERRED EMBODIMENT

Figure 1:
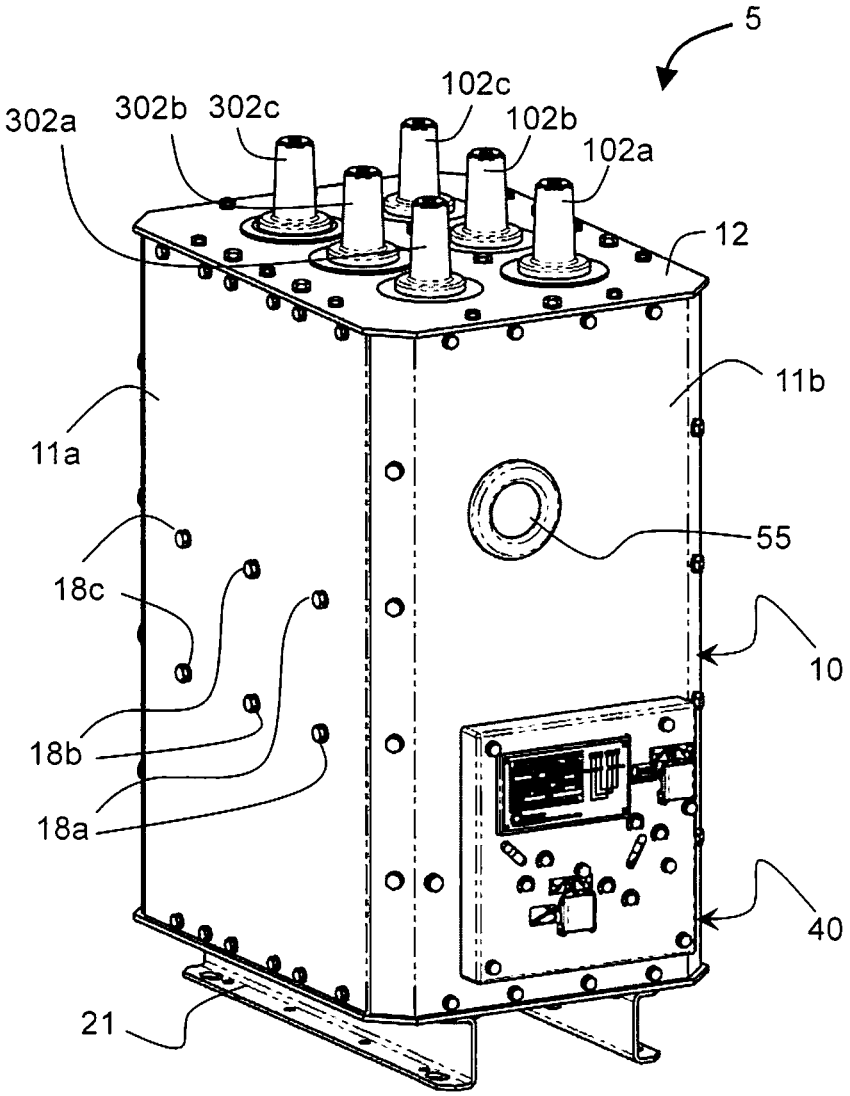
FIG. 1 is a left front perspective view of a preferred vacuum interrupter switch assembly constructed in accordance with the invention.
Figure 2:
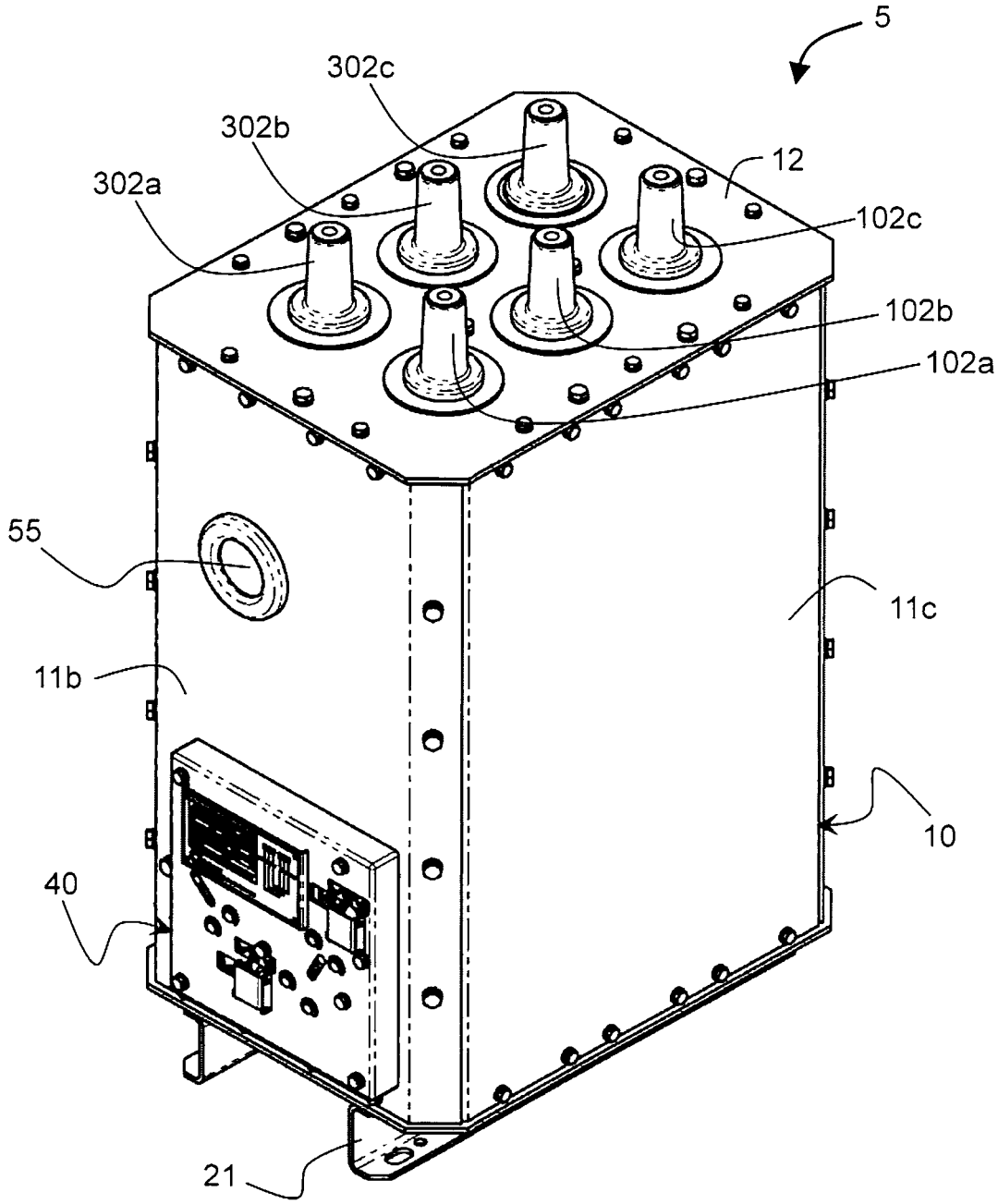
FIG. 2 is a right front perspective view of the vacuum interrupter switch assembly of FIG. 1.
Figure 3:
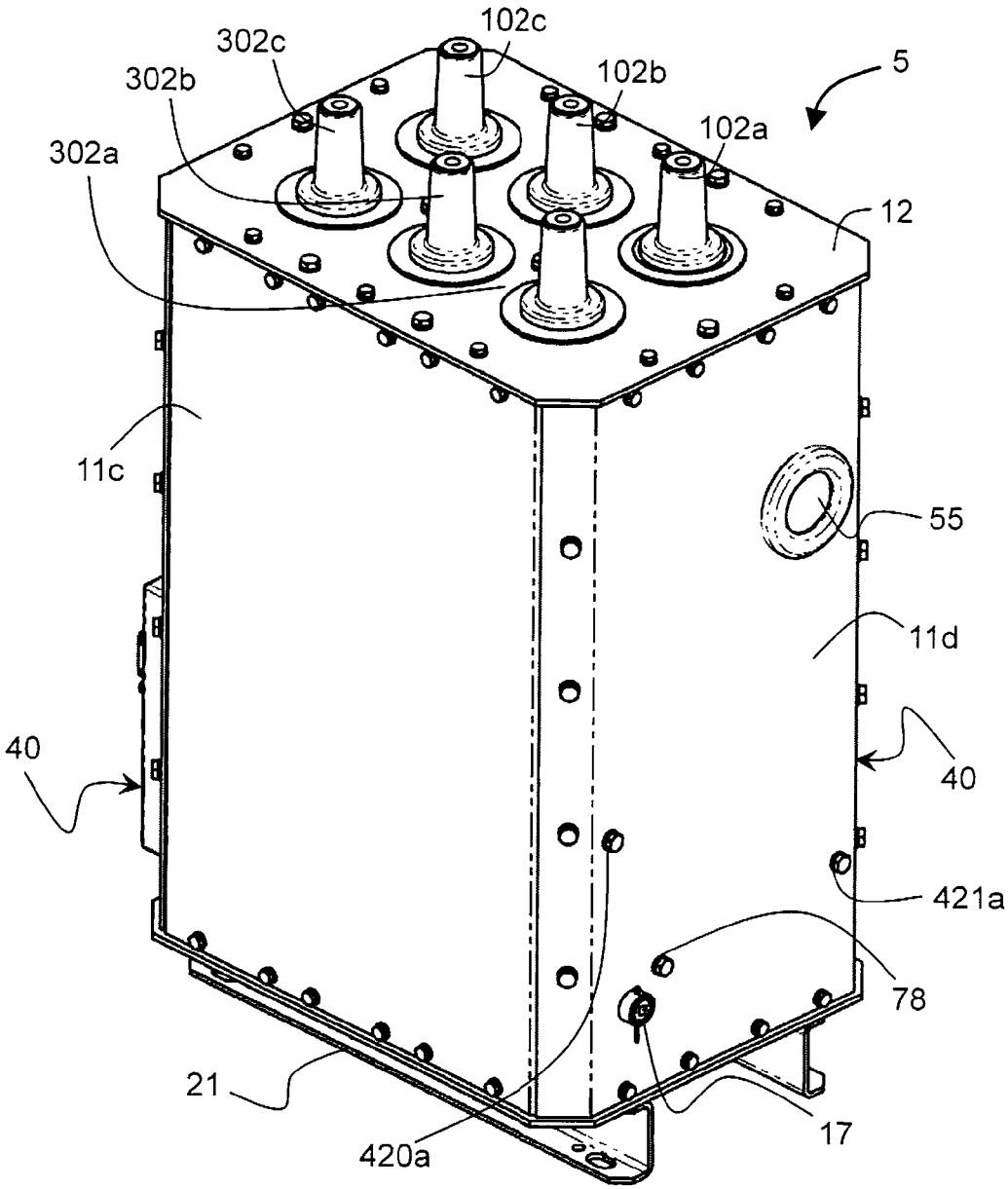
FIG. 3 is a right back perspective view of the vacuum interrupter switch assembly of FIG. 1.

Referring to FIGS. 1-3, a preferred three-phase, two-way, submersible loadbreak vacuum interrupter switch assembly 5 constructed in accordance with the invention is illustrated. The assembly comprises of an outer case 10, formed from a sturdy, corrosive-resistant material. The preferred material is stainless steel. The dimensions of case 10 are preferably approximately 16.7 inches wide by 39 inches high by 25 inches deep to fit within existing access holes and underground spaces available for switching assemblies. Each switch assembly case 10 is filled with dry air. Neither oil nor $SF_6$ gas is used. Case 10 preferably has sides 11*a-d*, bottom 13, and cover 12 welded together along the abutting edges. Front side 11*b* has viewing window 55 and the back side 11*d* has viewing window 55. As will become clear later, the viewing window permits personnel to view power interruption switches inside the sealed case in order to determine if the switches are open or closed, with the interior of the case 10 being illuminated through the rear window by exterior daylight, a room light, a flashlight, or other source of illumination. It is foreseeable that the vacuum interrupter switch assembly 5 will be placed against a wall, however, rendering the backside window useless, and it may accordingly be desirable to have a second window installed on the front side 11*b* to enable a flashlight to be shined into the case via the second window while the first front window is used to view the illuminated power interruption switch. Viewing window 55 on the back side can accordingly be moved to the front side, if necessary, or a third window or larger window can simply be used on the front of the illustrated case.

Two sets of three power bushings (302*a*, 302*b*, 302*c* and 102*a*, 102*b*, 102*c*) extend out from cover 12. As illustrated in FIGS. 1-3, power bushings 302*a*, 302*b*, and 302*c* extend from the left region of the cover, while power bushings 102*a*, 102*b*, and 102*c* extend from the right region of the cover. In use, the incoming three-phase power feeder cable is electrically coupled to power bushings 302*a*, 302*b*, and 302*c*. The power bushings 102*a*, 102*b*, and 102*c* are electrically coupled to branch circuits to provide three-phase power. For this invention, the preferred power bushings are manufactured under the Elastimold trademark by Thomas & Betts Corporation (Memphis, Tenn.).

Figure 4:
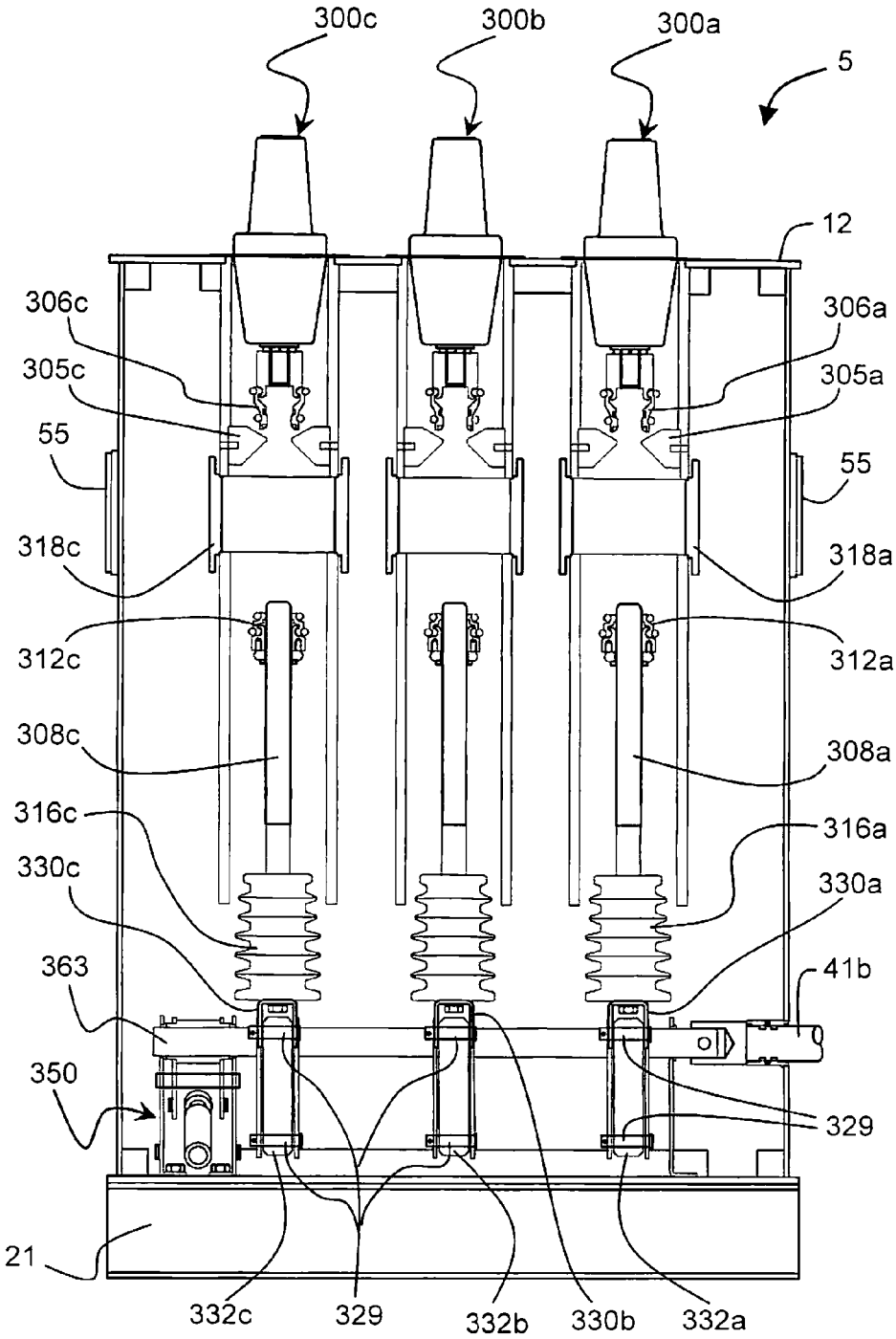
FIG. 4 is a cut-away left side elevation view in schematic of the vacuum interrupter switch assembly of FIG. 1, illustrating the preferred internal layout of the disconnect switch assembly components.
Figure 5:
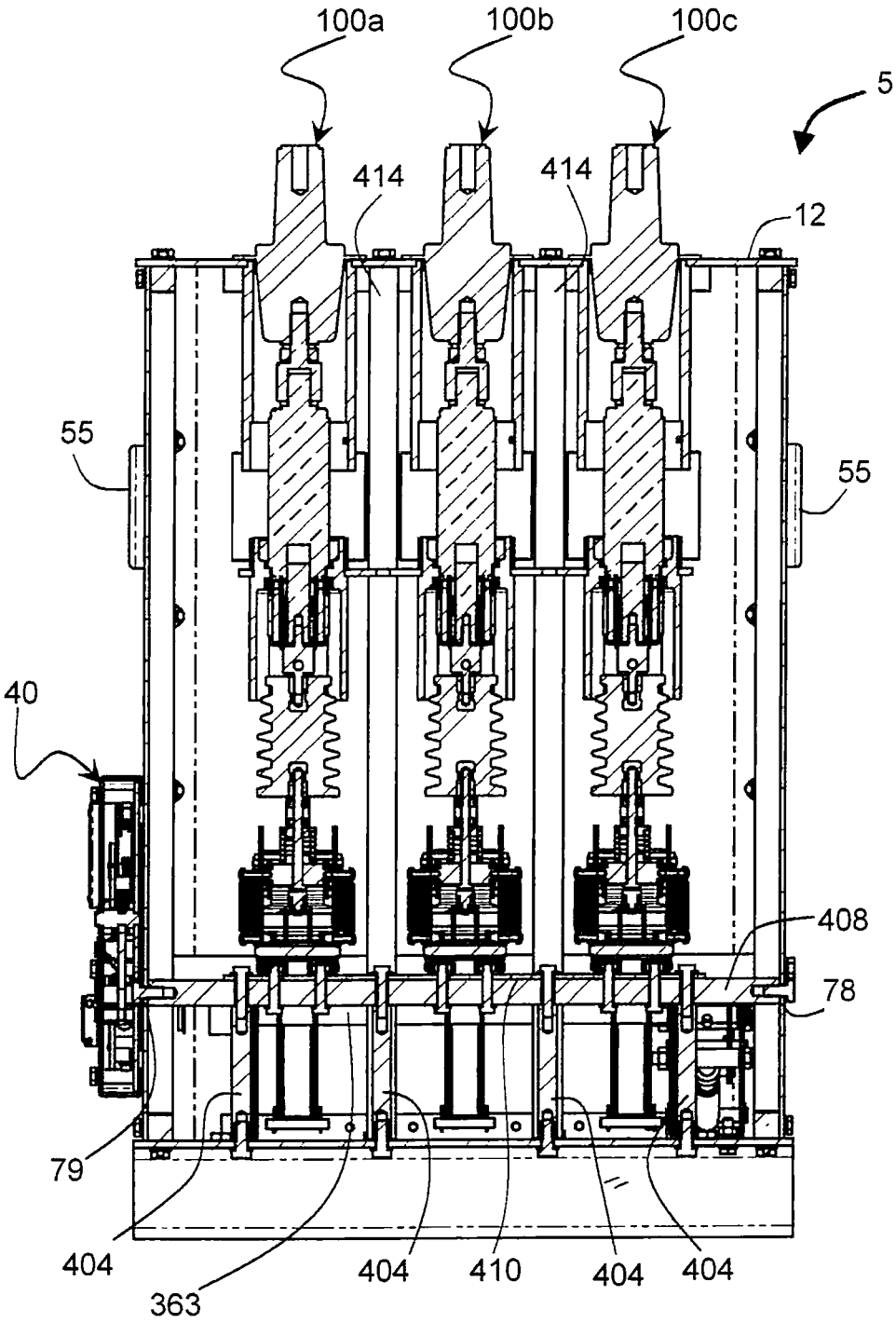
FIG. 5 is a cut-away right side elevation view of the vacuum interrupter switch assembly of FIG. 1, illustrating the internal layout of the vacuum interrupter bottle switch assembly components.
Figure 6:
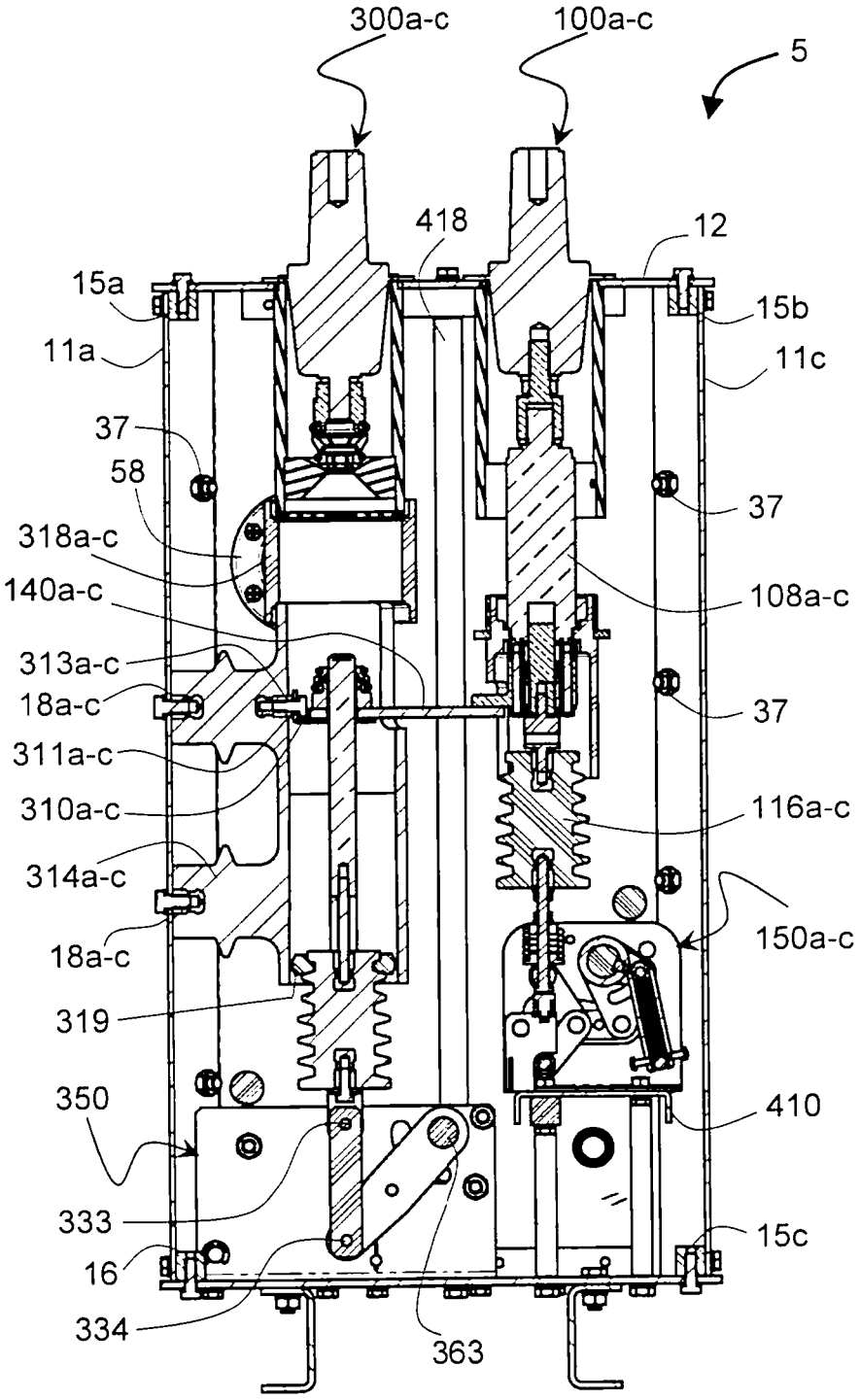
FIG. 6 is a cut-away front elevation view of the vacuum interrupter switch assembly of FIG. 1, illustrating the preferred internal layout of components for the disconnect switch and vacuum interrupter bottle switch assemblies.

FIG. 4 is a cut-away left side elevation view of the switch assembly 5 illustrating the preferred layout of the assembly's preferred internal disconnect switch assemblies 300*a*, 300*b*, and 300*c*. FIG. 5 is a cut-away right side elevation view of the preferred vacuum interrupter switch assembly 5 illustrating the preferred internal layout of the vacuum interrupter bottle switch assembly components 100*a*, 100*b*, and 100*c*. FIG. 6 is a cut-away front elevation view of the preferred vacuum interrupter switch assembly illustrating the preferred internal layout of the preferred components for the disconnect switch assemblies 300*a*, 300*b*, and 300*c* and vacuum interrupter bottle switch assemblies 100*a*, 100*b*, and 100*c*.

Figure 7:
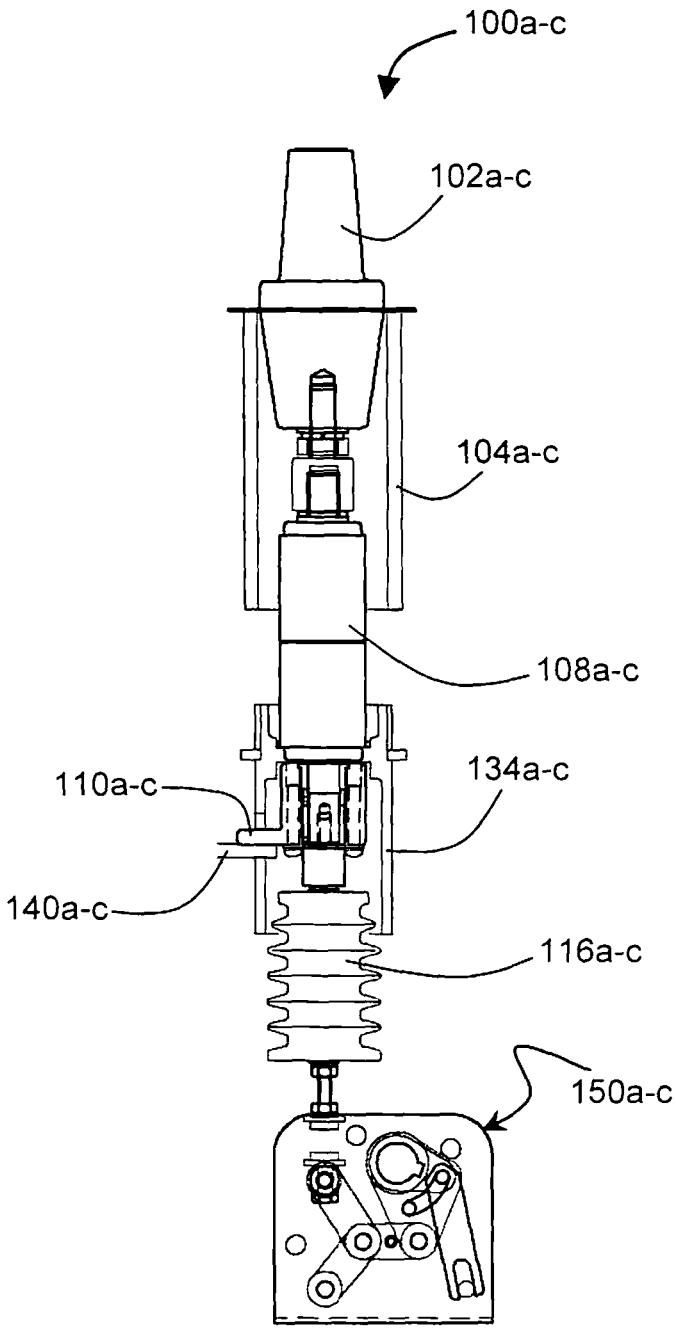
FIG. 7 is a side elevation view, in schematic, of a preferred vacuum interrupter bottle switch assembly constructed in accordance with the invention, with its operating mechanism shown in cut-away schematic form.
Figure 12:
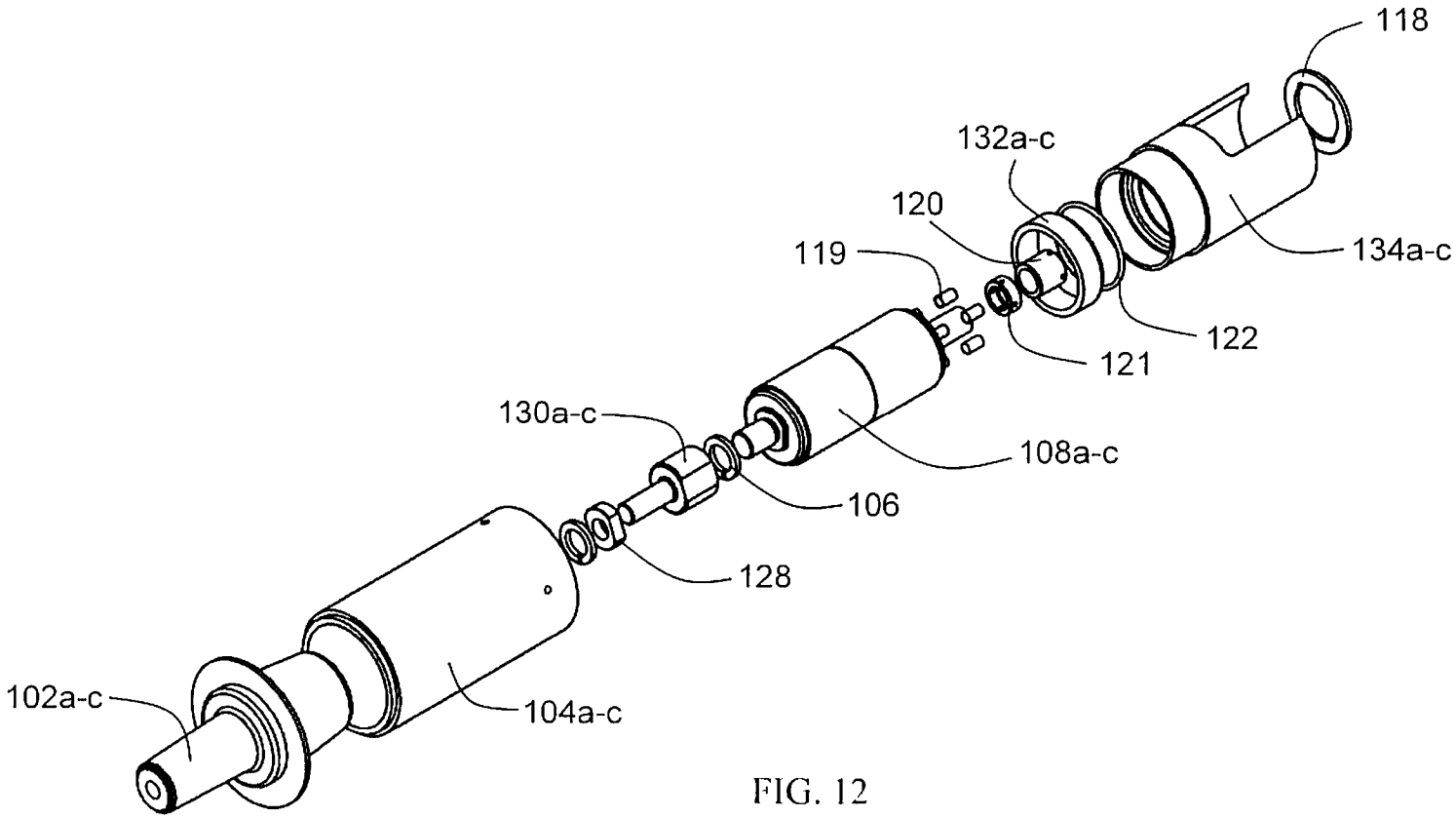
FIG. 12 is an explosion view of a preferred vacuum interrupter bottle switch assembly without an operating mechanism.

FIG. 7 is a side elevation view, in schematic, of a preferred vacuum interrupter bottle switch assembly constructed in accordance with the invention, with its operating mechanism shown in cut-away schematic form. As illustrated in FIGS. 7 and 12, vacuum interrupter bottle switch assemblies 100*a*, 100*b*, and 100*c* each generally comprise a power bushing 102*a-c*, an insulation shield 104*a-c*, a vacuum interrupter bottle switch 108*a-c*, a common bus connector 110*a-c*, a push-pull insulator 116*a-c*, and an operating mechanism assembly 150*a-c*. For the sake of brevity, it will be understood that a description of a component having an "a" suffix following its reference numeral will also serve as a description of a corresponding component having a "b" or "c" suffix service unless otherwise stated in the specification or as evident from the Figures. Likewise, all three corresponding components may be referred to with the suffix "a-c" following the reference numeral.

As illustrated in FIGS. 5 and 6, vacuum interrupter bottle switch assembly 100*a* extends vertically upward and out of cover 12. Vacuum interrupter bottle switch assembly 100*b* extends vertically upward and out of cover 12, behind vacuum interrupter bottle switch assembly 100*a* and generally parallel thereto. Vacuum interrupter bottle switch assembly 100*c* extends vertically upward and out of cover 12, behind vacuum interrupter bottle switch assembly 100*b* and generally parallel thereto.

Figure 8:
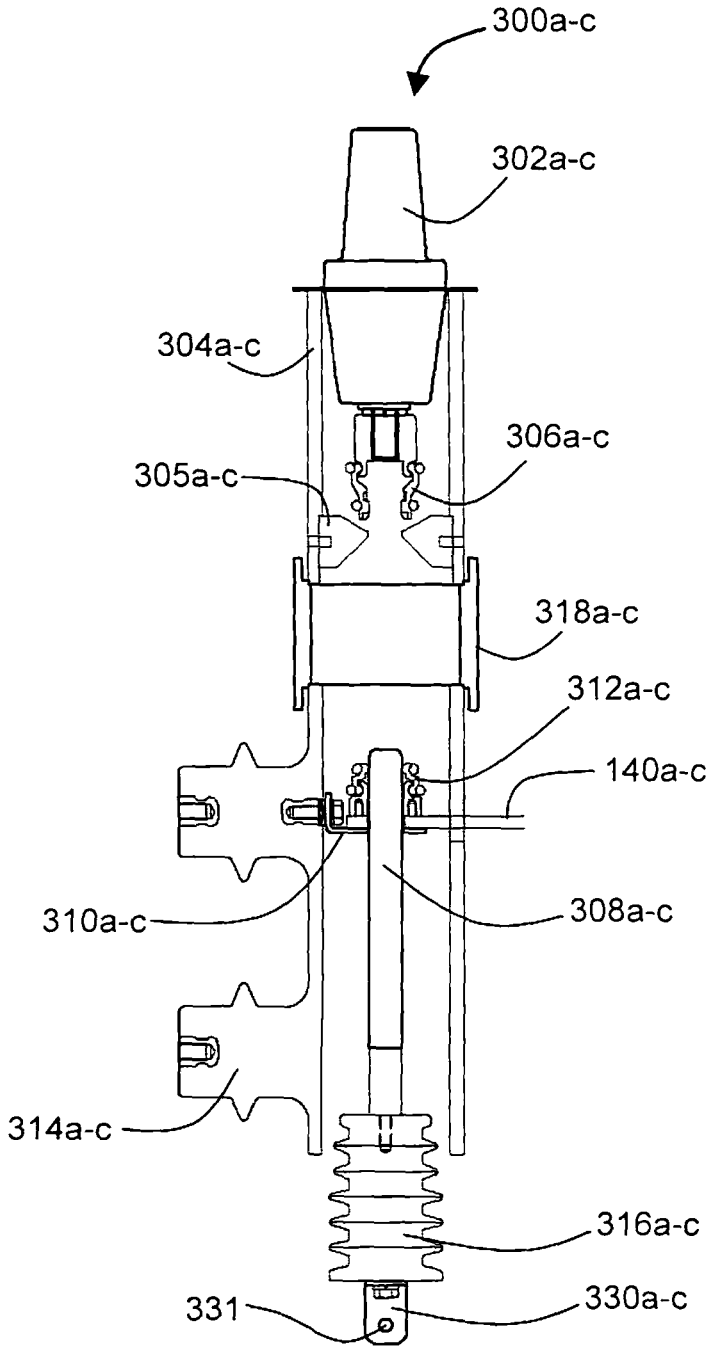
FIG. 8 is a front partially-sectioned elevation view in schematic of a preferred disconnect switch assembly constructed in accordance with the invention.

FIG. 8 is a front partially-sectioned elevation view in schematic of a preferred disconnect switch assembly constructed in accordance with the invention. Disconnect switch assemblies 300*a*, 300*b* and 300*c* are all represented in FIG. 8, with the nomenclature 300*a-c*. Corresponding elements of the respective disconnect switch assemblies are denoted similarly. Disconnect switch assembly 300*a-c* is generally comprised of a power bushing 302*a-c*, an insulating shield 304*a-c*, a transparent insulating shield 318*a-c*, top contact 306*a-c* and bottom contact 312*a-c*, a contact rod 308*a-c*, an insulating shield 314*a-c*, and a push-pull insulator 316*a-c*. As illustrated in FIGS. 4 and 6, internal disconnect switch assembly 300*a* extends vertically upward and out of cover 12. Internal disconnect switch assembly 300*b* extends vertically upward and out of cover 12 behind internal disconnect switch assembly 300*a* and generally parallel thereto. Internal disconnect switch assembly 300*c* extends vertically upward and out of cover 12 behind internal disconnect switch assembly 300*b* and generally parallel thereto.

As illustrated in FIG. 6, each vacuum interrupter bottle switch assembly 100*a-c* is mechanically and electrically coupled to a corresponding disconnect switch assembly 300*a-c* through bus 140*a-c*. Bus 140*a-c* is connected to L-bracket 310*a-c* (best shown in FIG. 8) of disconnect switch assembly 300*a-c* and to connector 110*a-c* (best shown in FIG. 7) of vacuum interrupter bottle switch assembly 100*a-c*.

As illustrated in FIG. 4, disconnect switch assemblies 300*a*, 300*b*, and 300*c* (shown in the open position) are connected to drive shaft 363 which is mechanically coupled to operating mechanism 350. Coupling to drive shaft 363 allows the disconnect switch assemblies 300*a-c* to be controlled in unison. Turning drive shaft 363 clockwise will push contact rods 308*a-c* through guides 305*a-c* from the shown "open" position into top contacts 306*a-c*, the "closed" position where upper contacts 306*a-c* and bottom contacts 312*a-c* are electrically coupled through contact rods 308*a-c*. From the closed position, turning drive shaft 363 counter clockwise pulls contact rods 308*a-c* out from top contacts 306*a-c* and back down to bottom contacts 312*a-c* and into the open position.

Figure 15:
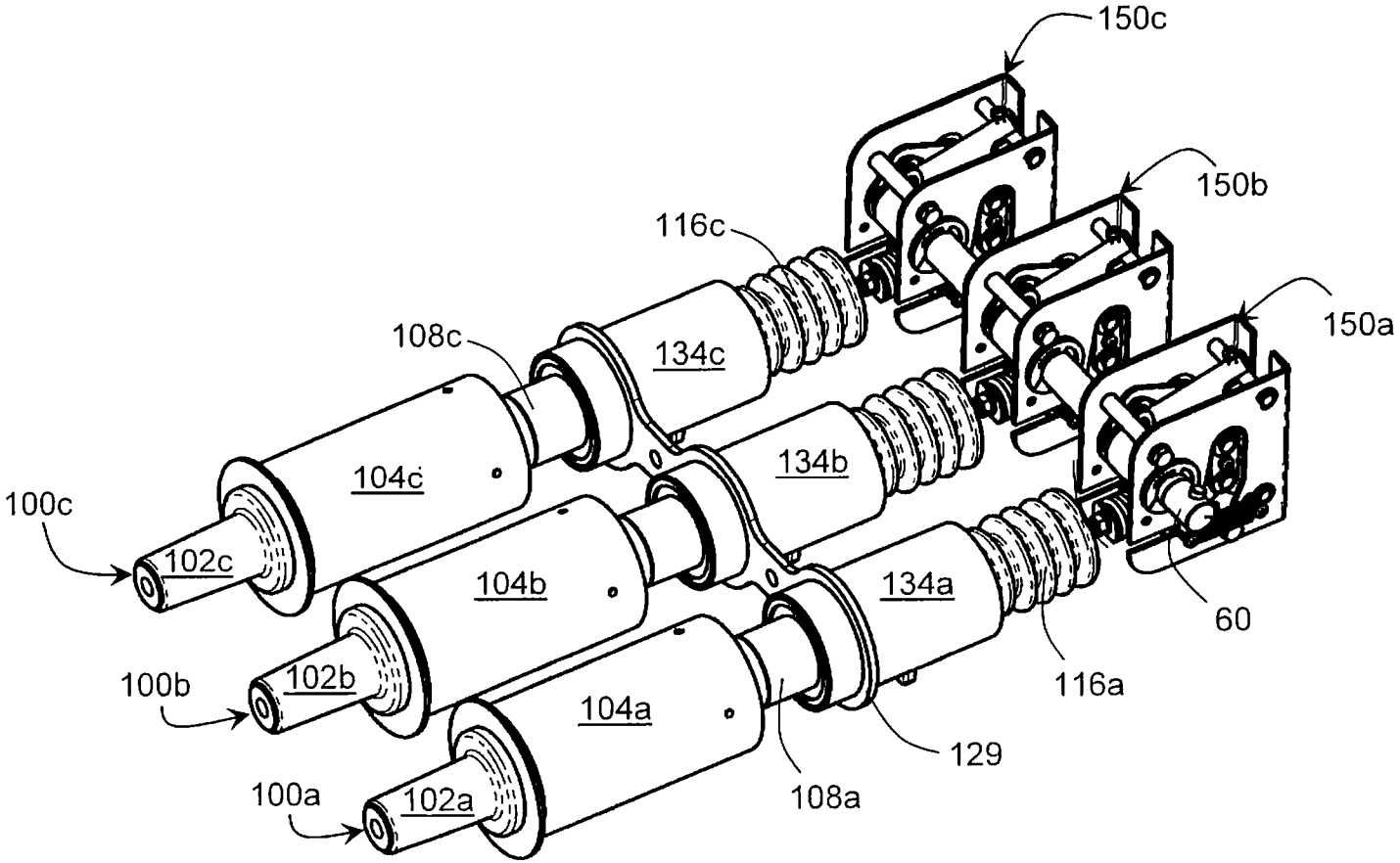
FIG. 15 illustrates a right front perspective view of the three-phase vacuum interrupter bottle switch assembly of FIG. 5.

As illustrated in FIG. 15, vacuum interrupter bottle switch assemblies 100*a*, 100*b*, and 100*c* are mechanically coupled to drive shaft 60 through operating mechanisms 150*a*, 150*b*, and 150*c*, respectively. Coupling to drive shaft 60 allows the vacuum interrupter bottle switch assemblies 100*a-c* to be controlled in unison. Referring to FIG. 6, the vacuum interrupter bottle switch assemblies 100*a-c* are seen in the open position. Turning drive shaft 60 clockwise results in pushing up the moveable contact of vacuum interrupter bottle switch 108*a-c* such that the internal contacts are pushed together. This is the closed position for the vacuum interrupter bottle switch assembly. From the closed position, turning drive shaft 60 counterclockwise pulls the moveable contact of vacuum interrupter bottle switch 108*a-c* downwards so that the internal contacts are pulled apart and into the open position.

Figure 9:
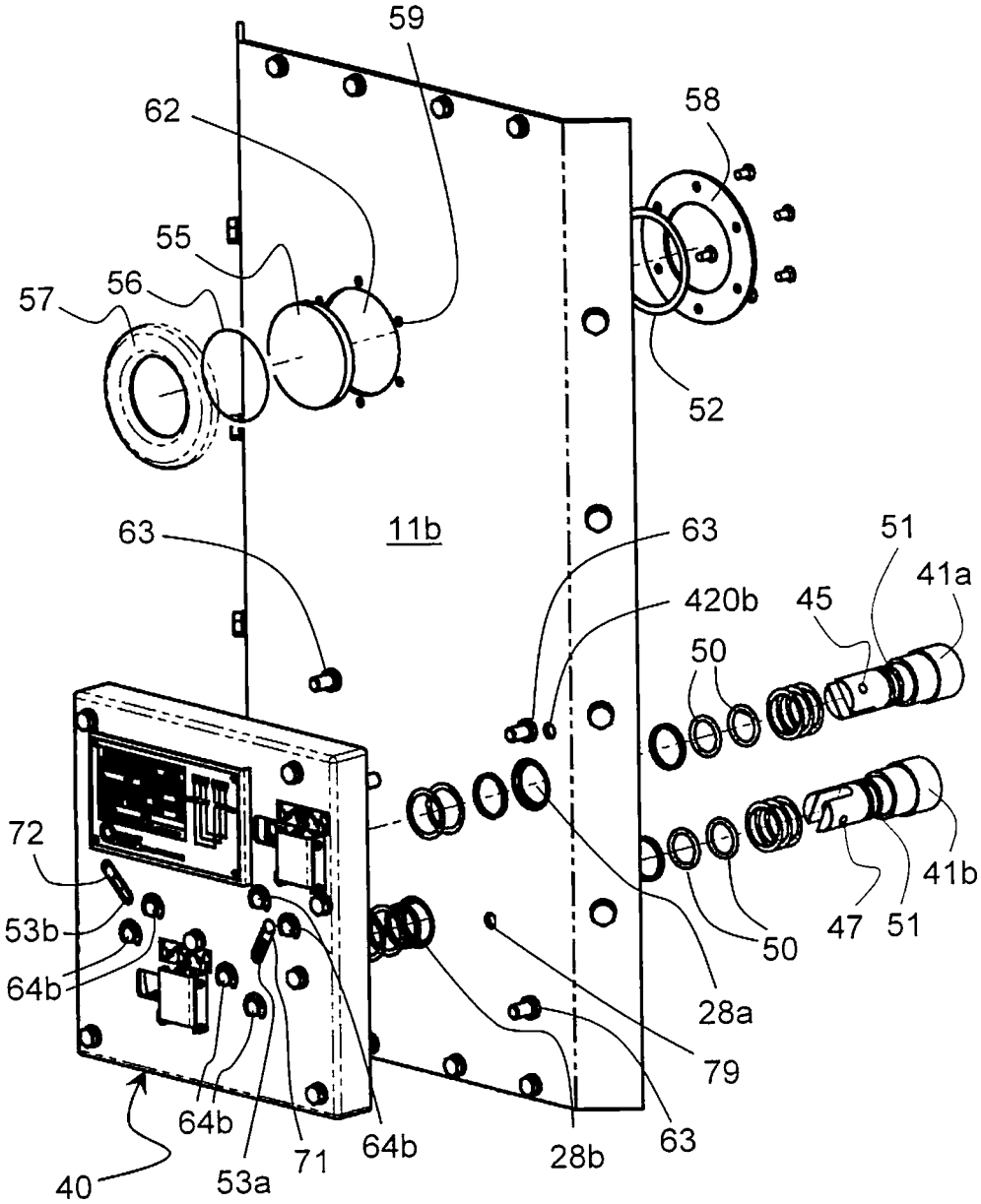
FIG. 9 is an exploded right side perspective view of the vacuum interrupter switch assembly of FIG. 1, illustrating the preferred interlocking control assembly.

FIG. 9 is an exploded right side perspective view of the vacuum interrupter switch assembly of FIG. 1, illustrating the preferred interlocking control assembly. As illustrated in FIG. 9, interlocking control assembly 40 is preferably affixed to front side 11*b*. Drive shafts 60 and 363 are mechanically connected to interlocking control assembly 40 via control shafts 41*a* and 41*b*, respectively. Interlocking control assembly 40 ensures proper and safe operation of the switch by preventing the internal disconnect switch assemblies 100*a-c* from opening or closing unless the vacuum interrupter bottle switches 108*a-c* are open.

If an underground vault has a 30-inch diameter access hole, then switch assembly 5 described above can fit through the hole, bottom side first, and into the vault. If smaller dimensions are desired, then a variety of dielectric materials can be utilized. Oil or $SF_6$ could also be used, but would re-introduce environmental hazards to the disclosed assembly and negate some of its features and benefits.

A variety of grounding methods are available for the switch assembly 5. One can, for example, weld ground rods to the case 10 so that a grounding wire can be connected to the rods. Alternatively, a bracket can be used so that a grounding wire with a terminal can be bolted on. Once positioned inside the vault, the vacuum interrupter switch can be grounded and synthetic power cables attached to power bushings 102*a-c* and 302*a-c* through power cable elbows such as those manufactured under the Elastimold trademark by Thomas & Betts Corporation (Memphis, Tenn.) and under the Cooper trademark by Cooper Power Systems (Waukesha, Wis.). For this invention, Elastimold is the preferred brand.

Assembly

The assembly of the preferred vacuum interrupter switch assembly will now be discussed. The construction and operation of a vacuum interrupter bottle switches are known to those of ordinary skill in the art, and are not discussed here for the sake of brevity.

Figure 10:
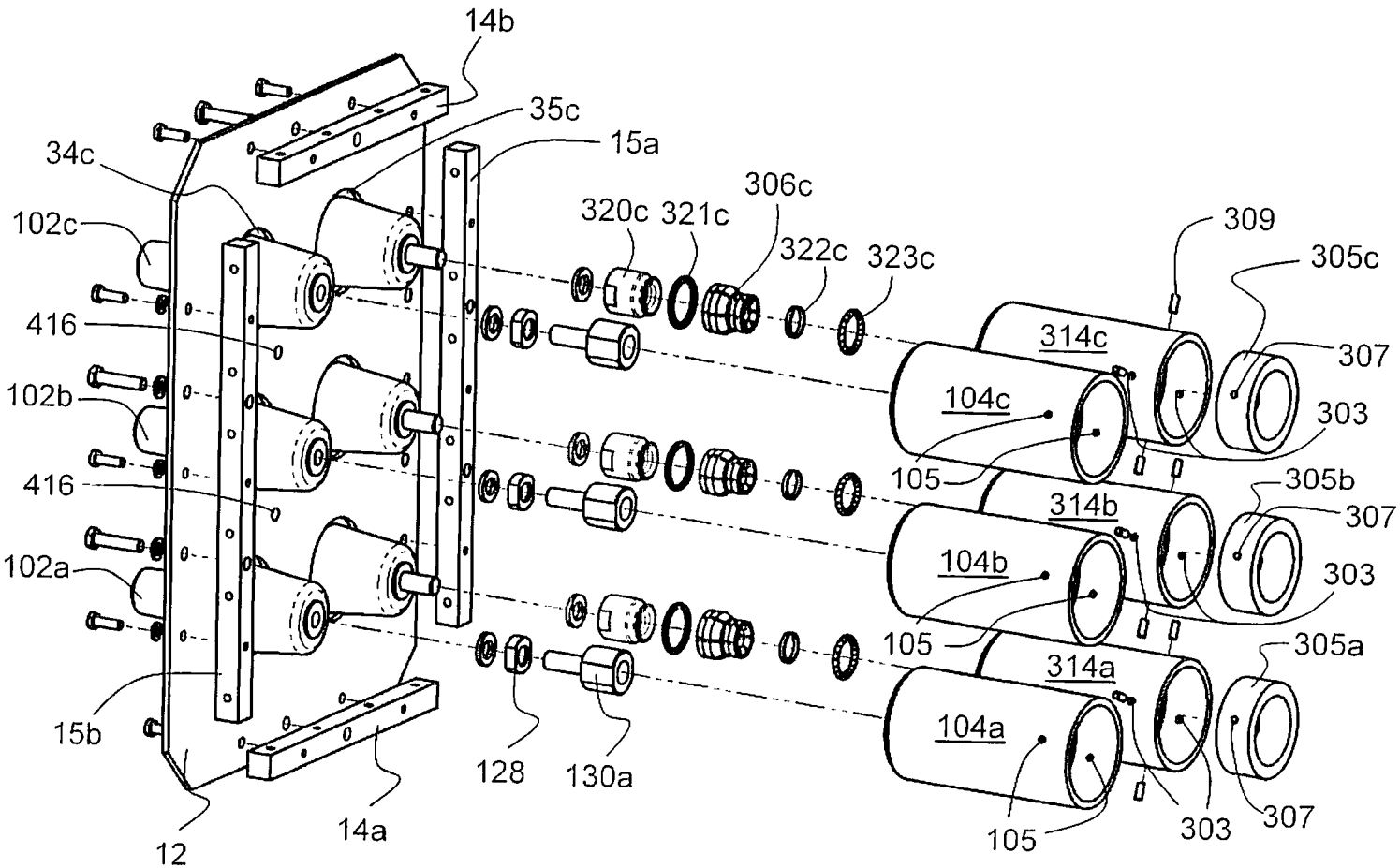
FIG. 10 is an exploded view of the components fastened to the inside of the cover of the vacuum interrupter switch assembly.
Figure 11:
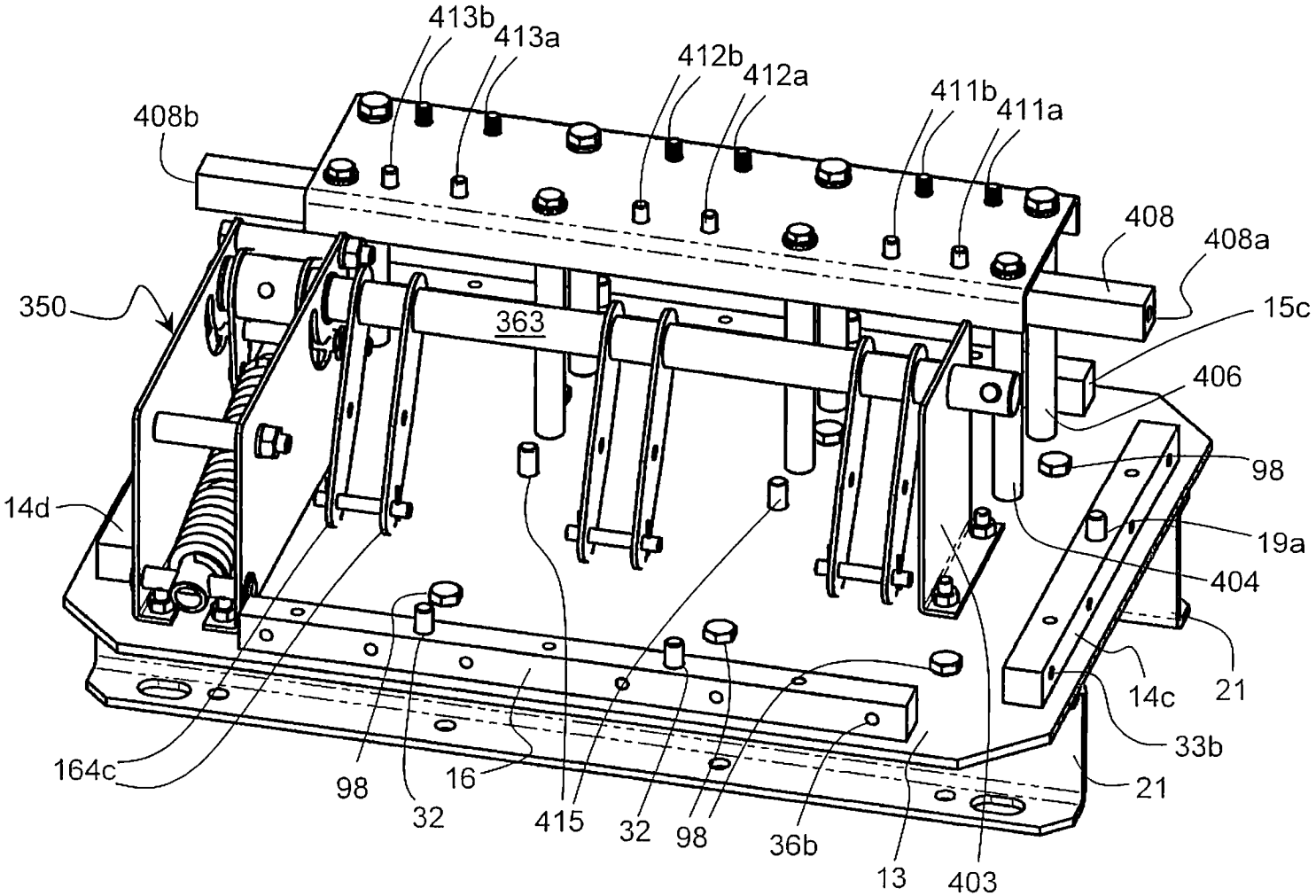
FIG. 11 is a left side elevation view of the preferred components fastened to the bottom of the preferred vacuum interrupter switch assembly.

FIG. 10 is an exploded view of the components fastened to the inside of the cover of the vacuum interrupter switch assembly, and FIG. 11 is a left side elevation view of the preferred components fastened to the bottom of the preferred vacuum interrupter switch assembly. Referring to FIGS. 10 and 11, support bars 14*a-d*, 15*a-c*, and 16 are bolted into place onto cover 12 and bottom 13 through threaded holes. Floor mounting brackets 21 are fastened with bolts, nuts, and lock washers to the underside of bottom 13 at points 98. Cylindrical support rods 404 and 406 are bolted to bottom 13 through threaded holes. As best illustrated in FIGS. 5 and 11, rectangular support rod 408 is laid on support rods 404. Support stand 410 is laid on rectangular support rod 408 and support rods 406. Support stand 410 is bolted to support rods 406 and, through rectangular support rod 408, to support rods 404.

Power bushing 102*a*, 102*b*, and 102*c* are inserted in respective holes in the cover and welded to cover 12. Power bushing 302*a*, 302*b*, and 302*c* are inserted in respective holes in the cover and welded to cover 12. Nut 128*a* and a lock washer are installed on the threaded portion of stud adapter 130*a* which is then threaded into power bushing 102*a*. Similarly, nuts and lock washers are installed on the threaded portion of stud adapters threaded into power bushing 102*b* and 102*c*.

A lock washer and connector 320*c* are threaded onto the stud of power bushing 302*c*. The large end of top contact 306*c* clasps onto the small end of connector 320*c*. Spring 321*c* is placed onto top contact 306*c* to hold it firmly onto connector 320*c*. Spacer 322*c* is placed into a small groove inside the small end of top contact 306*c*. Spring 323*c* is placed around the small end of top contact 306*c*. The same is done for the other two power bushings.

As best shown in FIG. 10, the right ends of shields 104*a-c* have holes 105. The ends of shields 104*a-c* without the holes 105 are installed onto power bushing 102*a*, 102*b*, and 102*c*, respectively. Similarly, the ends of shields 304*a-c* without holes 303 are installed onto power bushing 302*a*, 302*b*, and 302*c*, respectively.

Guides 305*a-c* are each cylindrically-shaped with an interior that is slanted so that one end has a smaller interior cross-section than the other end. Guides 305*a*, 305*b*, and 305*c* are inserted smaller end first into power bushings 302*a*, 302*b*, and 302*c*, respectively. All holes 307 are aligned with holes 303 and inserted with a peg 309.

Vacuum Interrupter Bottle Switch Assembly 100

Figure 13:
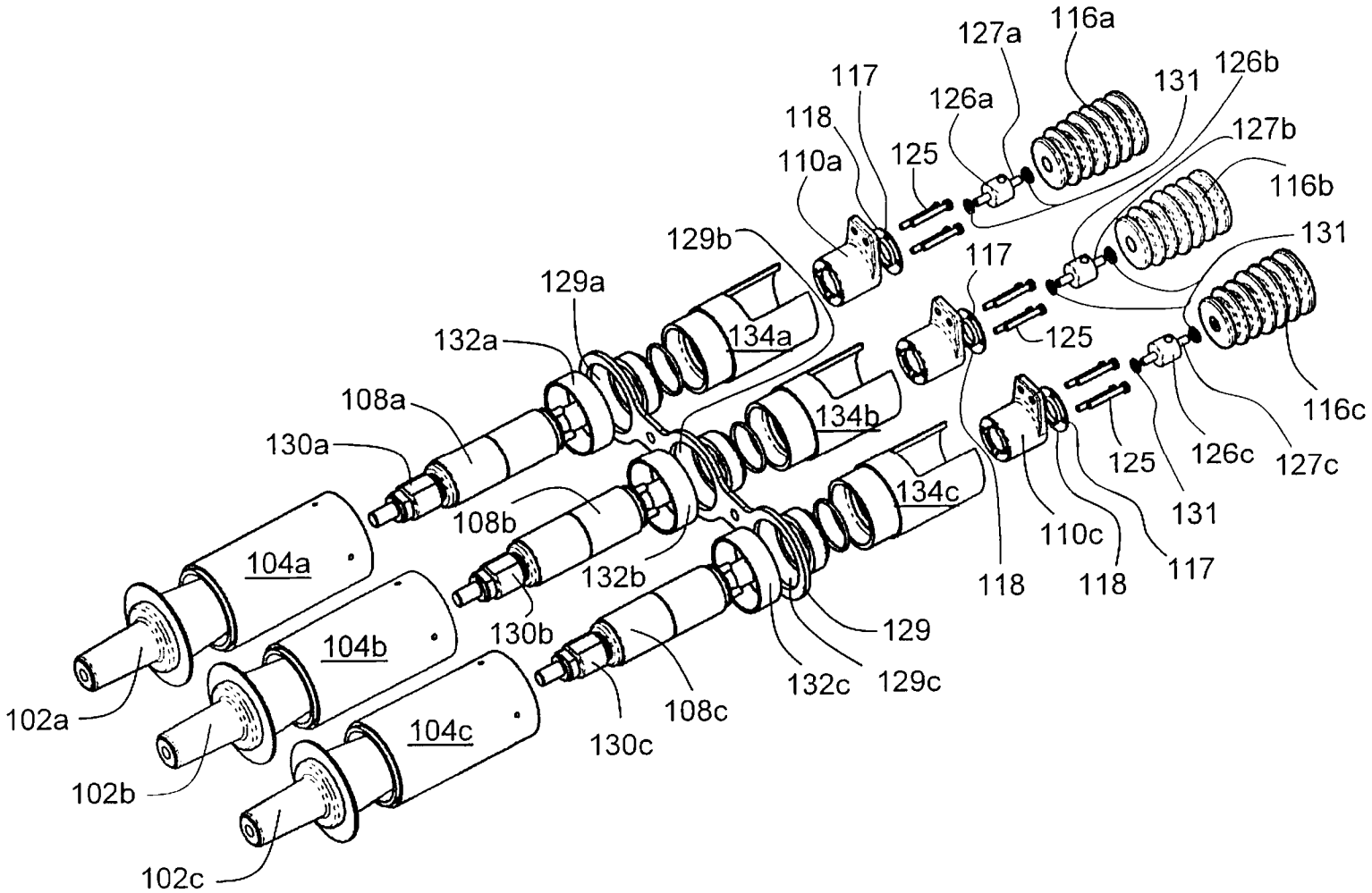
FIG. 13 is an explosion view of the preferred three-phase vacuum interrupter bottle switch assembly without the operating mechanisms.

Assembly of the preferred vacuum interrupter bottle switch assembly is best understood with reference to FIGS. 12 and 13. A lock washer 106 is installed onto the stationary contact for vacuum interrupter bottle switches 108*a*, 108*b*, and 108*c* which are then threaded into stud adapters 130*a*, 130*b*, and 130*c*, respectively.

Four insulating cylinders 119 cover the four short studs surrounding the moveable contact of vacuum interrupter bottle switch 108*a*. A short threaded cylindrical spacer 121 and a long threaded cylindrical spacer 120 are screwed onto the moveable contact for vacuum interrupter bottle switch 108*a* and tightened against one another. The same is done to vacuum interrupter bottle switches 108*b* and 108*c*.

A threaded rod 127*a* with metal spacer 126*a* has lock washers 131 placed on both ends and is screwed into the internal threads of the movable contact for vacuum interrupter bottle switch 108*a*. The same is done to vacuum interrupter bottle switches 108*b* and 108*c*.

Insulation cover tops 132*a*, 132*b*, and 132*c* are loosely installed over vacuum interrupter bottle switches 108*a*, 108*b*, and 108*c*, respectively. Assembly holder 129 is loosely installed over vacuum interrupter bottle switches 108*a*, 108*b*, and 108*c* through respective holes 129*a*, 129*b*, and 129*c*. An O-ring 122 is fitted around the movable contact end of vacuum interrupter bottle switches 108*a*, 108*b*, and 108*c*. From openings 135*a*, 135*b*, and 135*c*, insulating covers 134*a*, 134*b*, and 134*c* are fitted over vacuum interrupter bottle switches 132*a*, 132*b*, and 132*c*, respectively.

Figure 14:
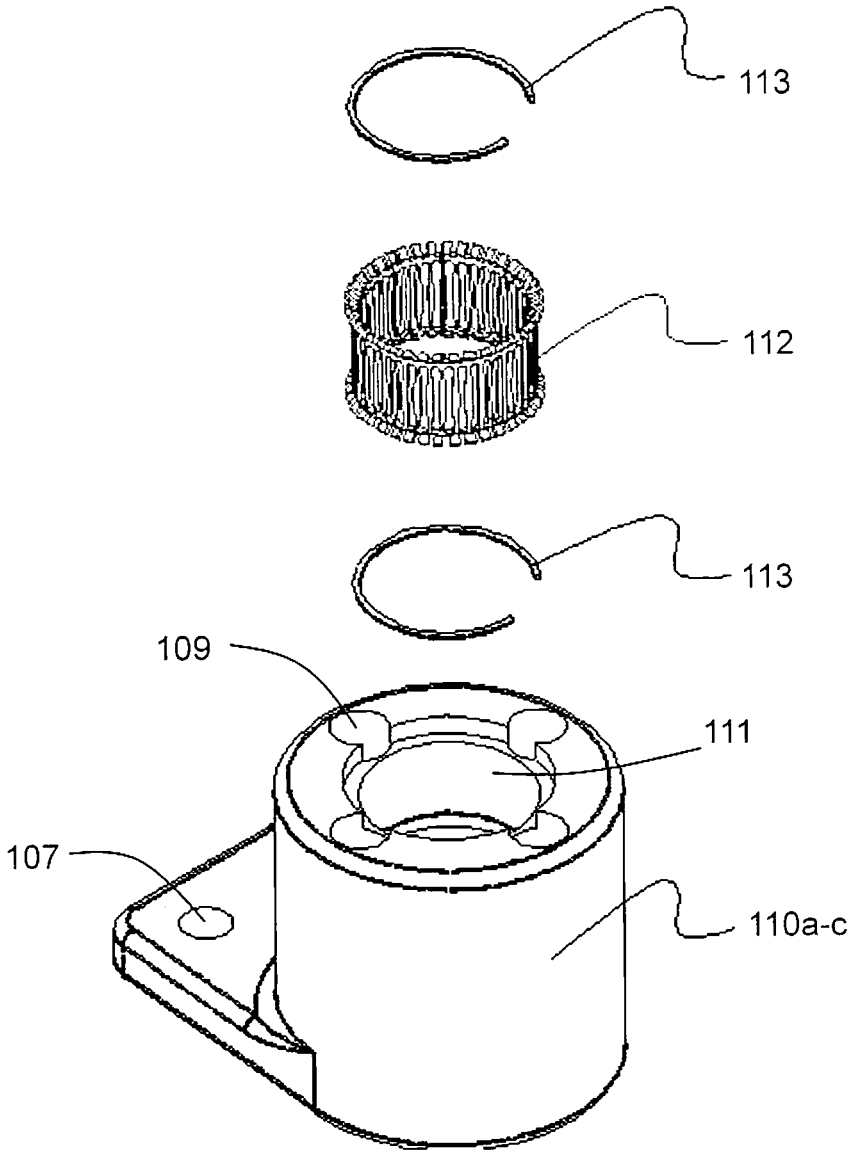
FIG. 14 is an explosion view illustrating the components of a preferred bus connector.

Bus connector 110*a-c*, as illustrated in FIGS. 13 and 14, comprises a generally cylindrical body with a rectangular flange at one end that has holes 107. The other end of the connector 110*a-c* has four holes 109 on the other end with internal grooves 111. Within groove 111 is a disposed band of torsion or leaf spring contact material 112. Contact elements of this type are sold, for example, under the Multilam trademark. C-clips 113 secure the Multilam contact 112 within groove 111.

As best illustrated in FIG. 13, bus connector 110*a* is inserted into insulating cover 134*a* through the slotted opening end, around metal spacer 126*a*, and installed onto vacuum interrupter bottle switch 108*a* by aligning its four holes 109 with the four studs (not shown) surrounding the movable contact of vacuum interrupter bottle switch 108*a*. An insulating spacer 118 is inserted into bus connector 110*a*, and around metal spacer 126*a*, with its holes 117 aligned with holes 109. Four screws 125 are inserted through holes 117 and 109 and screwed into the four studs surrounding the movable contact for vacuum interrupter bottle switch 108*a*. The same is done with corresponding components to respect to vacuum interrupter bottle switches 108*b* and 108*c*.

Operating Mechanism Assembly 150

Figure 27:
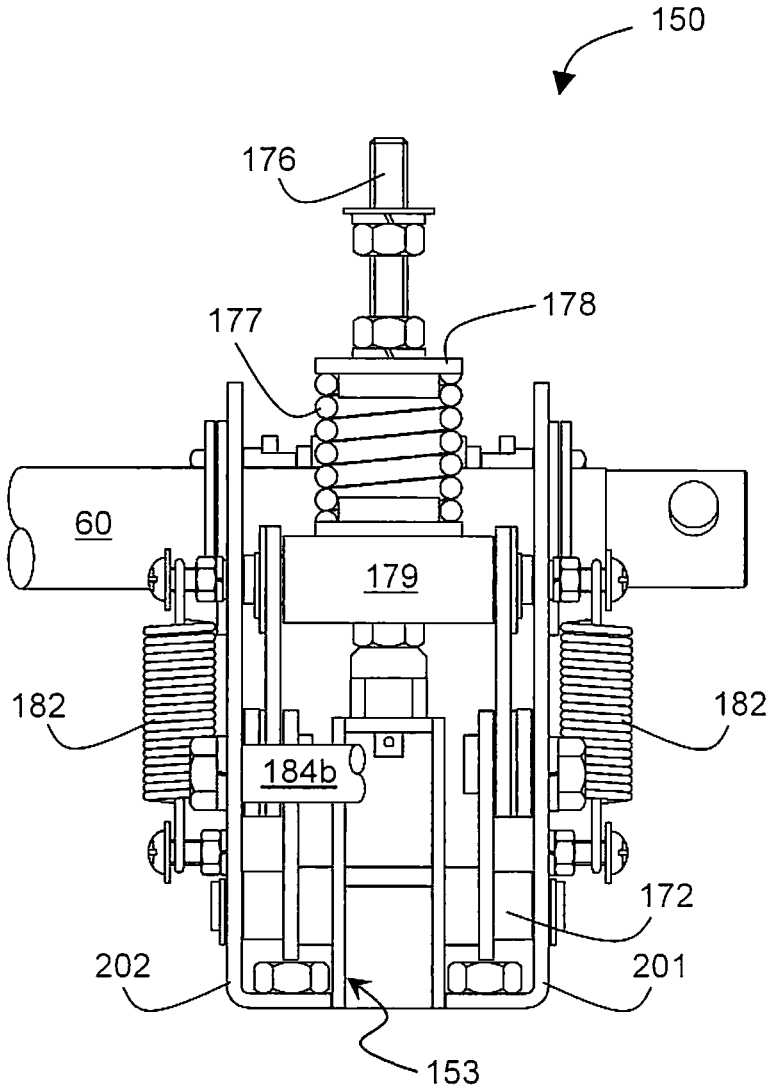
FIG. 27 is a side view of the preferred operating mechanism assembly for the preferred vacuum interrupter bottle switch assembly.
Figure 28:
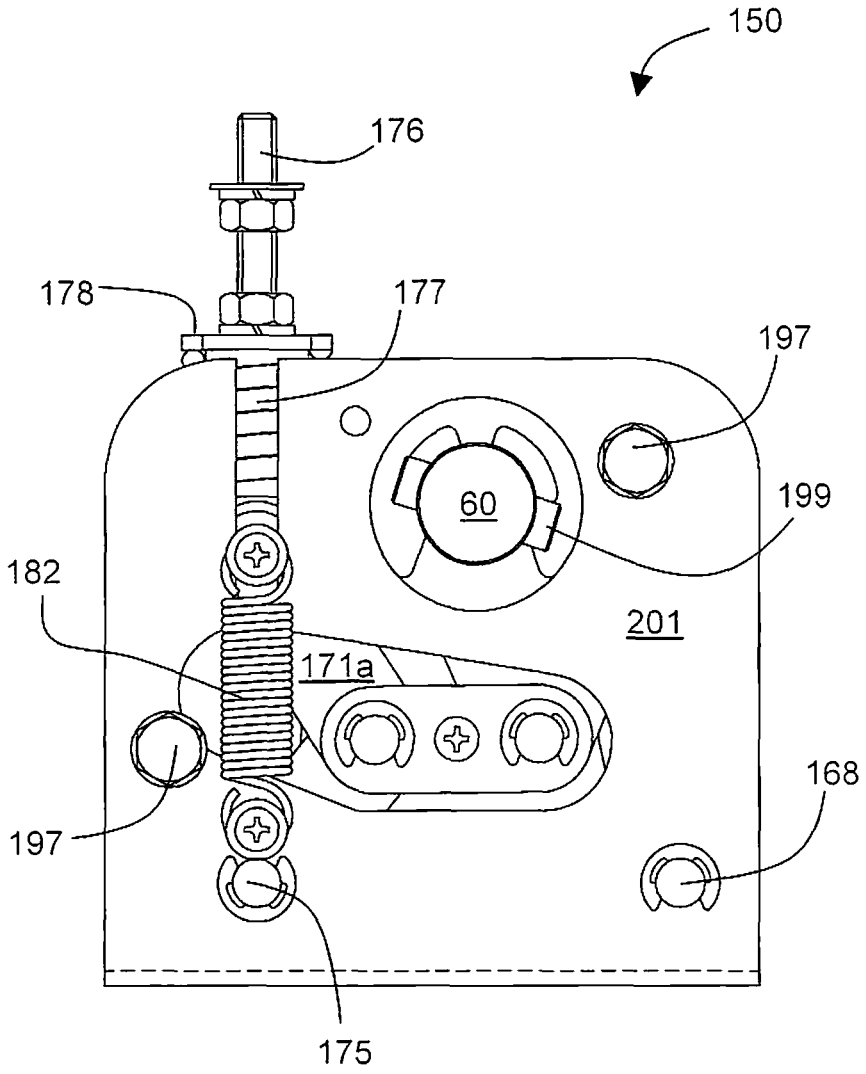
FIG. 28 is a front view of the operating mechanism assembly of FIG. 27.
Figure 29:
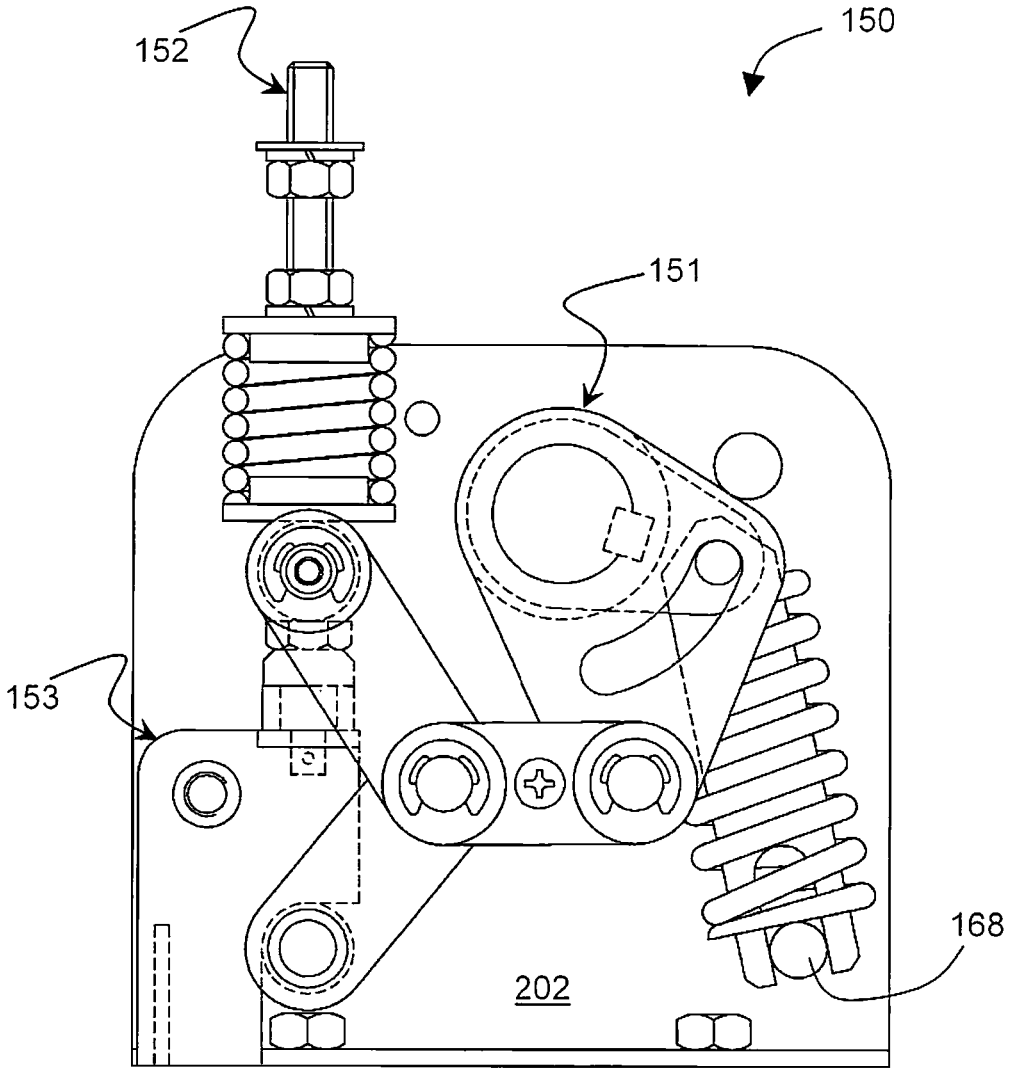
FIG. 29 is an internal view of the operating mechanism assembly of FIG. 27.
Figure 30:
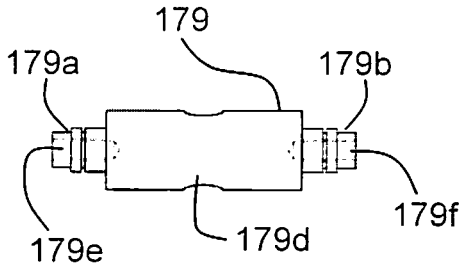
FIG. 30 is a side view of a preferred spring support rod.
Figure 31:
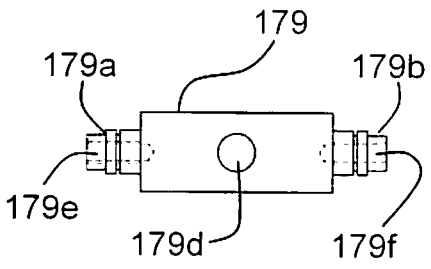
FIG. 31 is a top view illustration of the spring support rod of FIG. 30

FIGS. 27-28 show right side and front perspective views of a preferred operating mechanism assembly 150 (FIGS. 7, 15) constructed in accordance with the invention. FIG. 29 is an internal view of the operating mechanism assembly 150. The operating mechanism assembly 150 comprises a drive shaft assembly 151, push-pull assembly 152, and damper assembly 153, and framing components. Three identical operating mechanisms are preferably used, and are designated as 150*a*, 150*b*, and 150*c* herein.

Figure 37A:
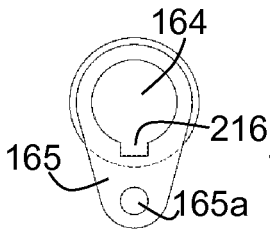
FIGS. 37A-Q are illustrations of components of the vacuum interrupter bottle switch assembly operating mechanism of FIG. 27.
Figure 37B:
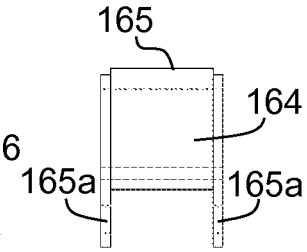
Figure 37C:
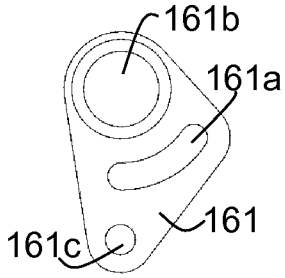
Figure 37D:
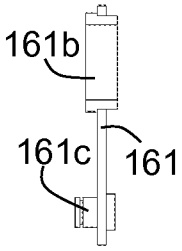
Figure 37E:
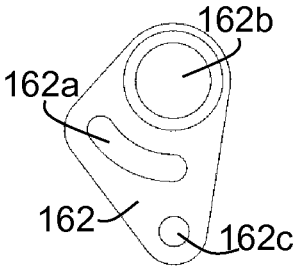
Figure 37F:
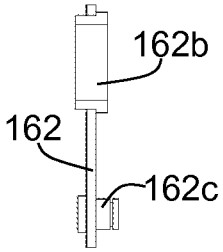
Figure 37G:
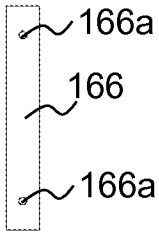
Figure 37H:
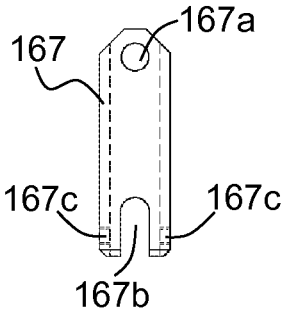
Figure 37I:
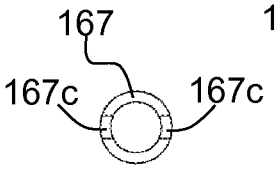
Figure 37J:
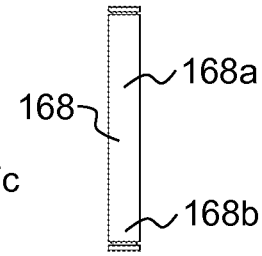
Figure 37K:
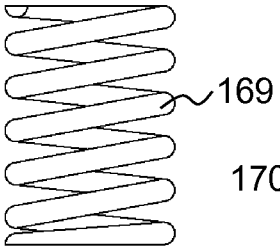
Figure 37L:
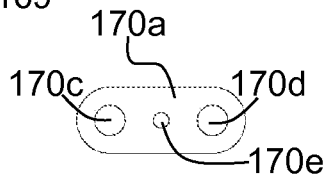
Figure 37M:
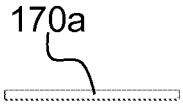
Figure 37N:
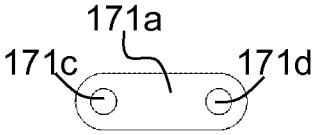
Figure 37O:
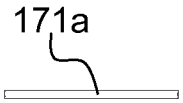
Figure 37P:
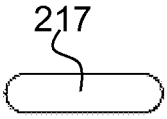
Figure 37Q:
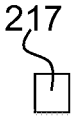
Figure 38A:
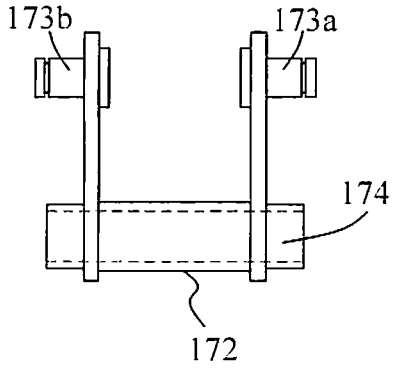
FIGS. 38A-H are illustrations of components of the vacuum interrupter bottle switch assembly operating mechanism of FIG. 27.
Figure 38B:
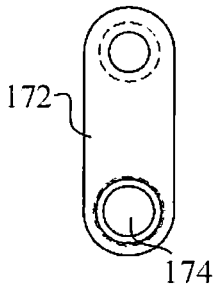
Figure 38C:
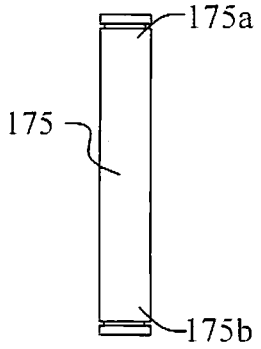
Figure 38D:
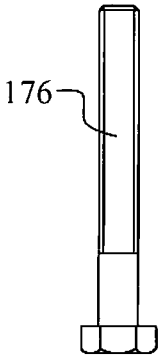
Figure 38E:
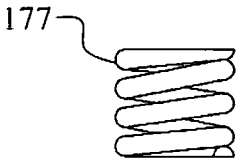
Figure 38F:
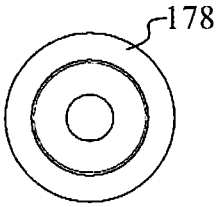
Figure 38G:
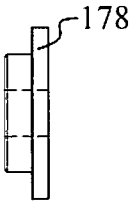
Figure 38H:
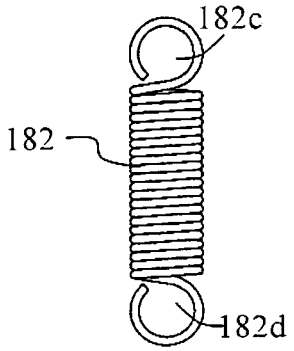
Figure 40A:
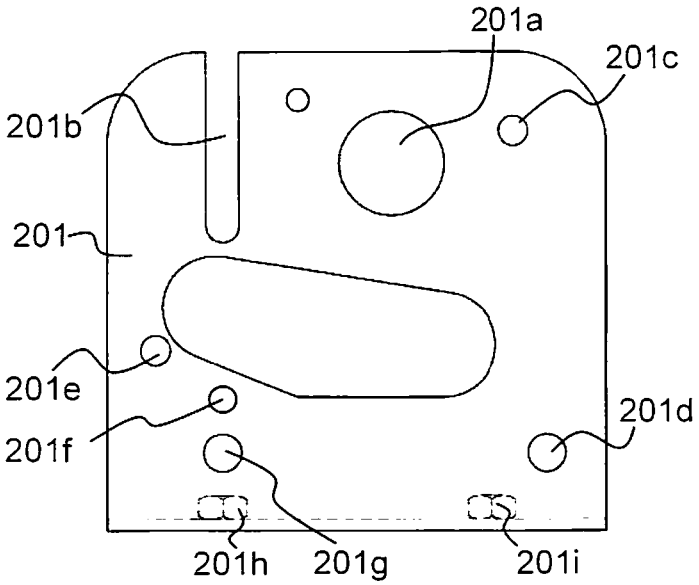
FIG. 40A-D are illustrations of components of the vacuum interrupter bottle switch assembly operating mechanism of FIG. 27.
Figure 40B:
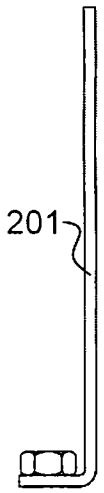
Figure 40C:
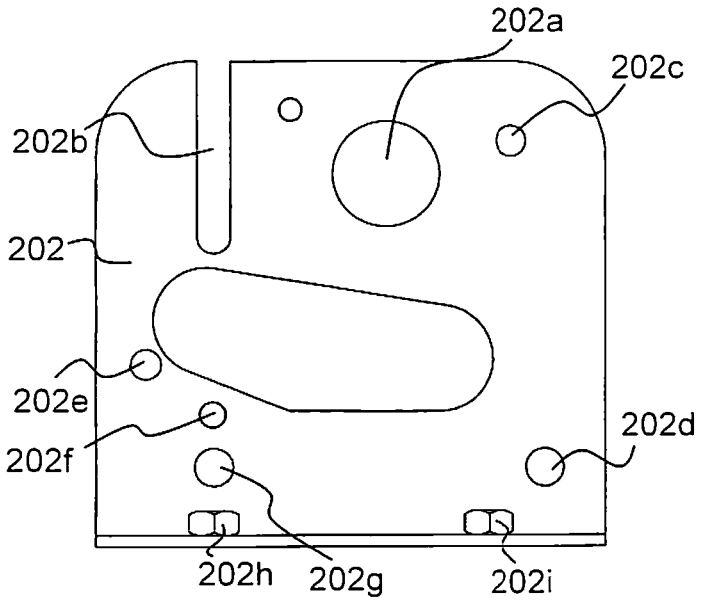
Figure 40D:
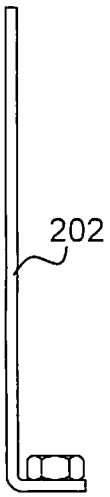
Figure 41:
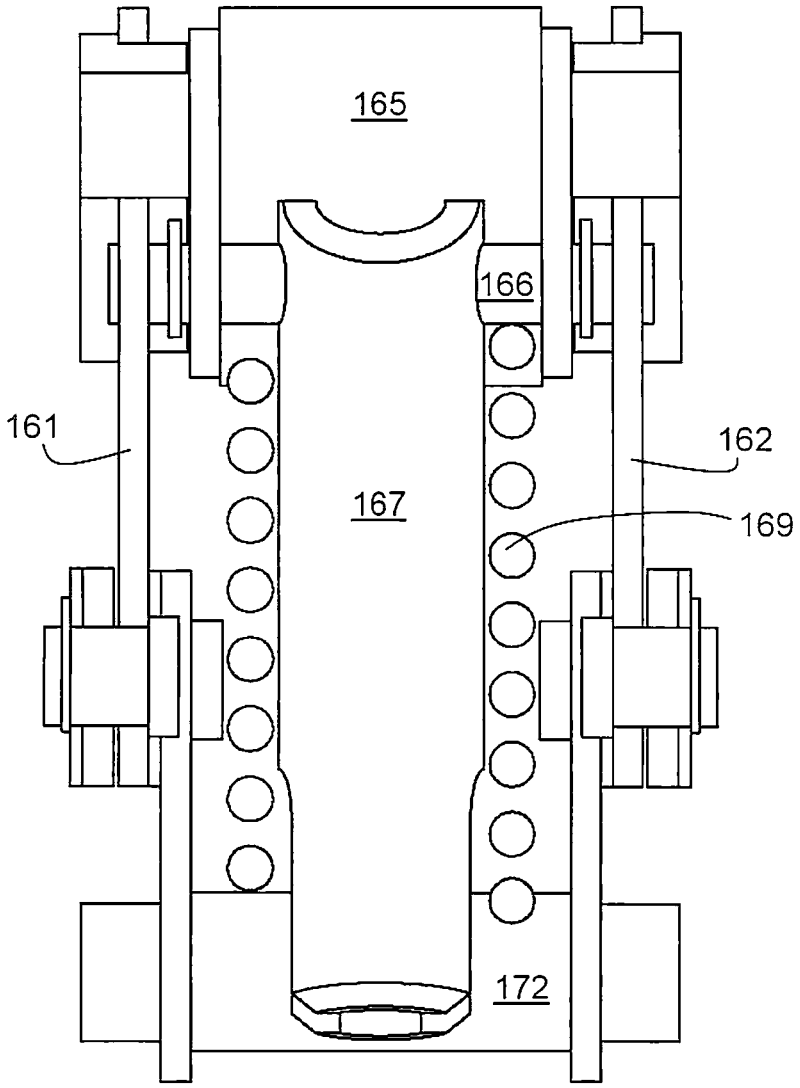
FIG. 41 is a right side cut-away view of FIG. 35.

Referring to FIGS. 35, 37A-Q, and 38A-H, the drive shaft assembly 151 is assembled with spring shaft 167 secured between the arms of rotating clevis 165 (FIG. 37B) by inserting pin 166 through holes 165*a* and hole 167*a* of spring shaft 167. Spring 169 is slid onto spring shaft 167 and held in place with screws at points 167*c*. Spring 169 is important since it controls the opening and closing speed of vacuum interrupter bottle switch 108. Pin 166 is held in place with cotter pins inserted into holes 166*a*. Lever arm 161 is fitted onto rotating clevis 165 with an end of pin 166 inserted into curved slot 161*a* and shaft opening 161*b* aligned with shaft opening 164 of rotating clevis 165. Pivot point 161*c* protrudes away from rotating clevis 165. Lever arm 162 is fitted onto rotating clevis 165 with the other end of pin 166 inserted into curved slot 162*a* and shaft opening 162*b* aligned with shaft opening 164 of rotating clevis 165. Pivot point 162*c* protrudes away from rotating clevis 165.

End 170*c* of toggle link 170*a* is fastened to pivot point 161*c* with a retaining washer. End 170*d* of toggle link 170*a* along with end 171*c* of toggle link 171*a* are fastened by retaining washers to pivot point 173*a* of clevis 172. Toggle link 170*b* is substantially identical in structure to toggle link 170*a*. End 170*c* of toggle link 170*b* is fastened to pivot point 162*c* with a retaining washer. End 170*d* of toggle link 170*b* along with end 171*d* of toggle link 171*b* is fastened by retaining washers to pivot point 173*b* of clevis 172. (Note: Toggle link 171*b* is substantially identical in structure to toggle link 171*a* (FIGS.

37N,O)). A threaded spacer 183 (FIG. 39A) is fitted between toggle links 170*a* and 170*b* and screwed into place at point 170*e* of both toggle links.

Referring to FIGS. 27-33 and 38A-H, the push-pull assembly 152 is assembled with bolt 176 inserted through hole 179*d* of spring support rod 179, bottom spring holder 178, overtravel spring 177, and top spring holder 178. A spring washer, two nuts, and a second spring washer are screwed onto bolt 176.

Referring to FIGS. 27, 29, 36 and 39, a damper assembly 153 includes a stopper 188 which is inserted through spacer 189, through hole 186 on support 185 and held in place with a cotter pin.

Figure 32:
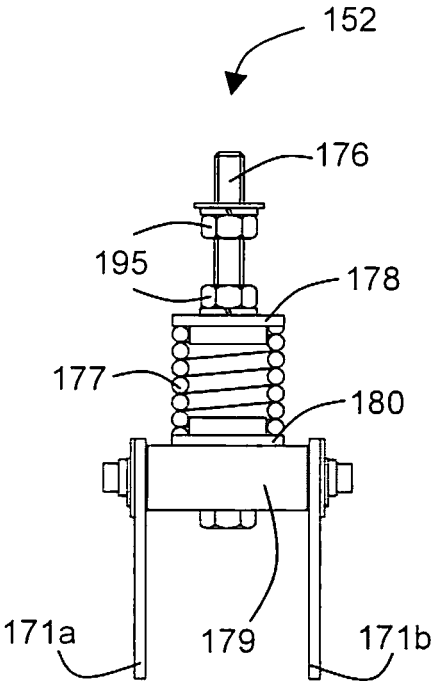
FIG. 32 is a side view illustration of the preferred push-pull assembly of FIG. 27.
Figure 33:
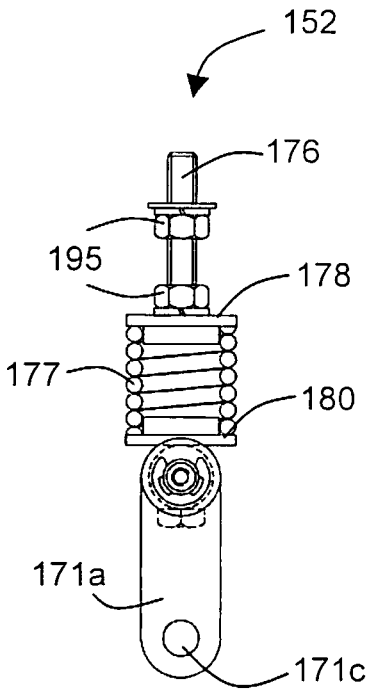
FIG. 33 is a front view illustration of the push-pull assembly of FIG. 32.

Drive shaft assembly 151 is connected to push-pull assembly 152 by fastening the end 171*d* of toggle link 171*a* to the end 179*a* of spring support rod 179 with a retaining washer, and fastening the end 171*d* of the toggle link 171*b* to the end 179*b* of spring support rod 179 with a retaining washer. In FIGS. 32 and 33, toggle links 171*a-b* of drive shaft assembly 151 are shown attached to push-pull assembly 152.

Referring to FIGS. 39 and 40, flanged spacers 200 are inserted into hole 202*a* on frame 202 and hole 201*a* on frame 201 from the non-flanged side. Spring support rod end 179*b* is inserted into slot 202*b* on frame 202. Bolt 197 is inserted into hole 202*c* of frame 202 and screwed into threaded spacer 184*a* at end 184*d*. A second bolt 197 is inserted into hole 202*e* of frame 202 and screwed into threaded spacer 184*b* at end 184*d*. Pivot rod 175 is inserted into pivot shaft 174 of clevis 172 with end 175*b* inserted into hole 202*g* and fastened in place with a retaining washer. Damper assembly 153 is installed onto spacer 184*b* through hole 185*a* and positioned between the arms of clevis 172 and on pivot shaft 174 at support point 185*b*.

Spring support end 179*a* is inserted into slot 201*b* on frame 201. A bolt 197 is inserted into hole 201*c* of frame 201 and screwed into threaded spacer 184*a* at end 184*c*. Another bolt 197 is inserted through hole 201*e* of frame 201 and screwed into threaded spacer 184*b* at end 184*c*. End 175*a* of pivot rod 175 is inserted through hole 201*g* and fastened into place with a retaining washer. Pin 168 is inserted through hole 202*d*, slot 167*b*, and hole 201*d* and fastened in place with retaining washers. The screws in points 167*c* are removed.

A support screw is fitted with a flat washer, nut, and spring washer and then screwed into hole 179*f* at spring support rod end 179*b*. A support screw is fitted with a flat washer, nut, and spring washer and then screwed into hole 202*f* of frame 202. Spring end 182*c* of spring 182 is hooked onto the support screw at support rod end 179*b*. Spring end 182*d* of spring 182 is hooked on the support screw at hole 202*f* of frame 202. A support screw is fitted with a flat washer, nut, and spring washer and then screwed into hole 179*e* at spring support rod end 179*a*. A second support screw is fitted with a flat washer, nut, and spring washer and then screwed into hole 201*f* of frame 201. Spring end 182*c* of another spring 182 is hooked onto the support screw at support rod end 179*a*. Spring end 182*d* of the second spring 182 is hooked on the support screw at hole 201*f* of frame 201 to complete the assembly of an operating mechanism designated as 150*a*. Two more operating mechanisms are assembled in the same manner and designated as 150*b* and 150*c*.

The small end of push-pull insulator 116*a* (FIGS. 7, 13) is screwed onto threaded rod 127*a* (FIG. 13). The large end of push-pull insulator 116*a* is screwed onto bolt 176*a* (FIGS. 32, 33) of operating mechanism 150*a*. The small end of push-pull insulator 116*b* is screwed onto threaded rod 127*b*. The large end of push-pull insulator 116*b* is screwed onto bolt 176*b* of operating mechanism 150*b*. The small end of push-pull insulator 116*c* is screwed onto threaded rod 127*c*. The large end of push-pull insulator 116*c* is screwed onto bolt 176*c* of operating mechanism 150*c*.

Turning to FIGS. 13 and 15, assembly holder 129 is fitted onto insulating covers 134*a*, 134*b*, and 134*c* through respective holes 129*a*, 129*b*, and 129*c*. Insulation cover tops 132*a*, 132*b*, and 132*c* are fitted onto insulating covers 134*a*, 134*b*, and 134*c*, respectively, with assembly holder 129 held firmly between them.

Figure 34:
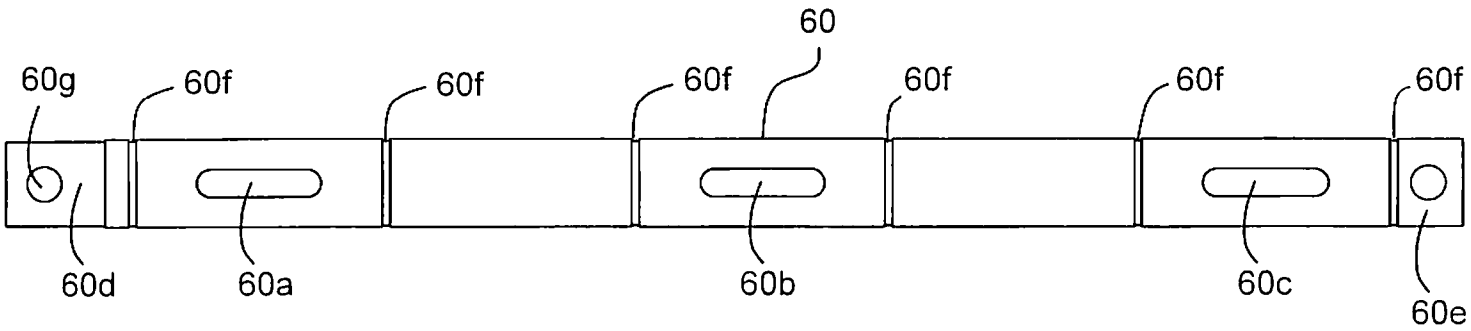
FIG. 34 is a side view of preferred operating shaft for the vacuum interrupter bottle assembly.
Figure 35:
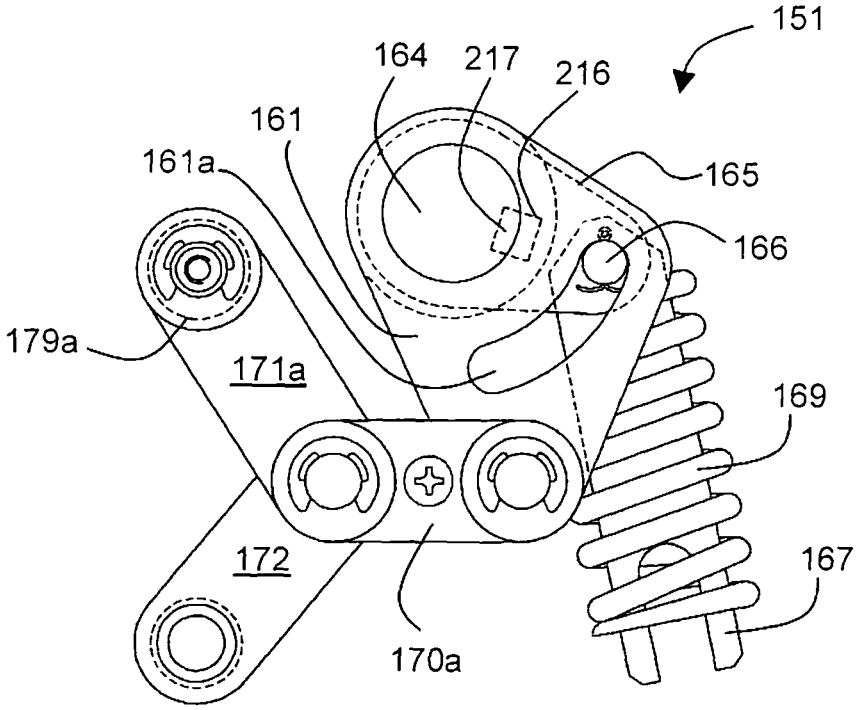
FIG. 35 is a front view illustration of the preferred drive shaft assembly of FIG. 27.
Figure 36:
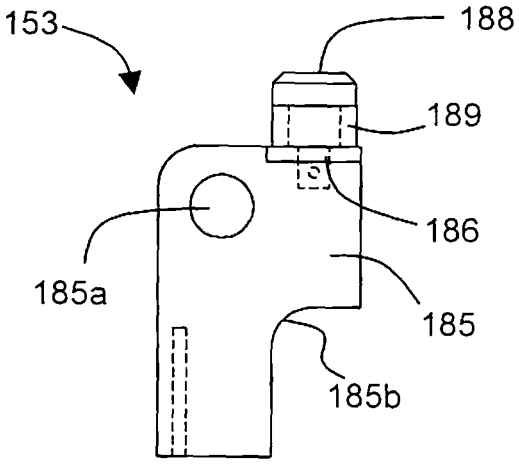
FIG. 36 is a front view illustration of the preferred damper assembly of FIG. 27.

The vacuum interrupter bottle switches 108*a-c* are mechanically linked together for operation in unison by driveshaft 60. A holding bar 217 is placed in slots 60*a*, 60*b*, and 60*c* of drive shaft 60. End 60*d* of drive shaft 60 is slid through operating mechanism 150*c* through its flanged spacer 200 of frame 202. End 60*d* of drive shaft 60 is then slid through operating mechanism 150*b* through its flanged spacer 200 of frame 202. End 60*d* of drive shaft 60 is then slid through operating mechanism 150*a* through its flanged spacer 200 of frame 202. Operating mechanism 150*a* is positioned over hole 60*a*. Operating mechanism 150*b* is positioned over hole 60*b*. Operating mechanism 150*c* is positioned over hole 60*c*. Drive shaft 60 is rotated until the holding bars 217 in slots 60*a*, 60*b*, and 60*c* fall into notches 216 of each operating mechanism. Drive shaft 60 is held in place with retaining washers at grooves 60*f* (FIG. 34). A lever rod 199 (FIG. 28) is inserted through drive shaft hole 60*g*. FIG. 15 best illustrates the assembled three-phase vacuum interrupter bottle switch assemblies 100*a*, 100*b*, and 100*c*.

Disconnect Switch Assembly 350

Figure 16:
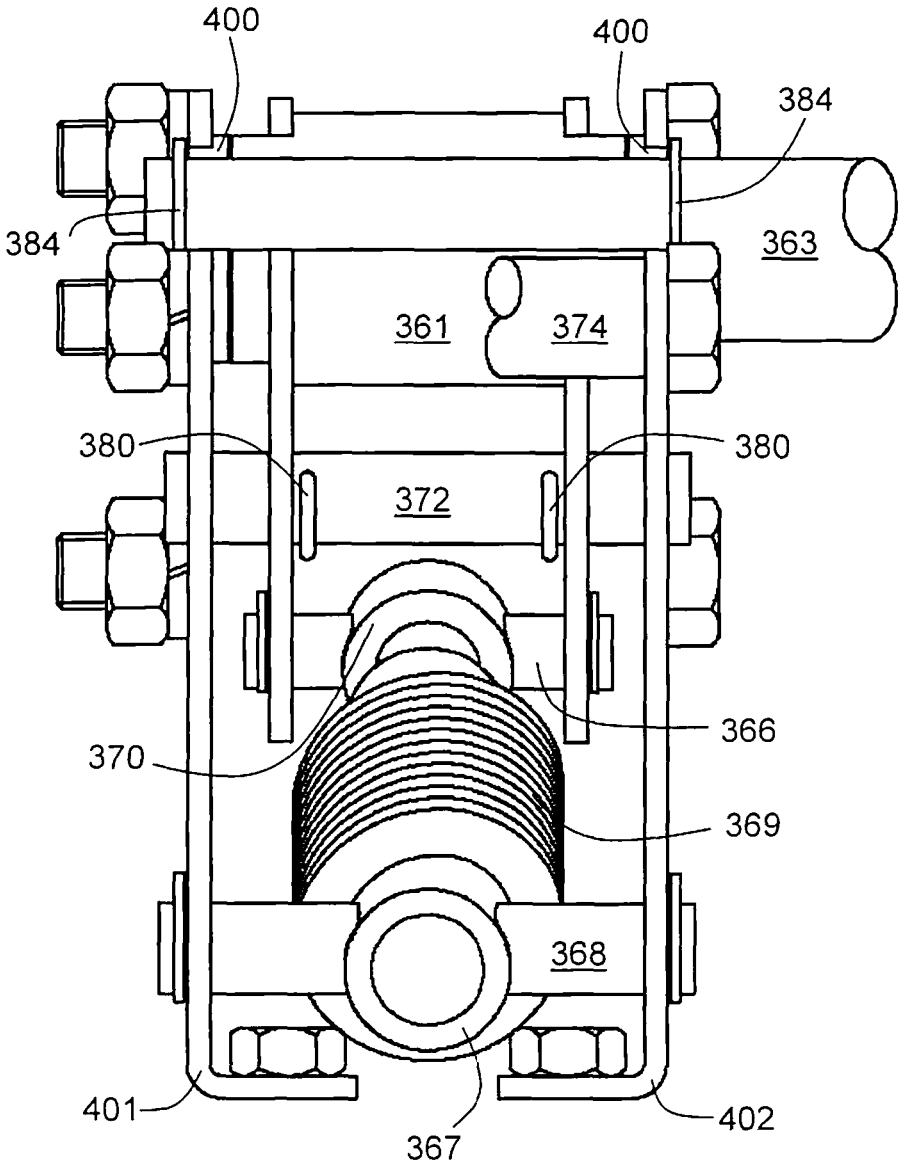
FIG. 16 is a left elevation view of the disconnect switch assembly operating mechanism in FIG. 4.
Figure 17:
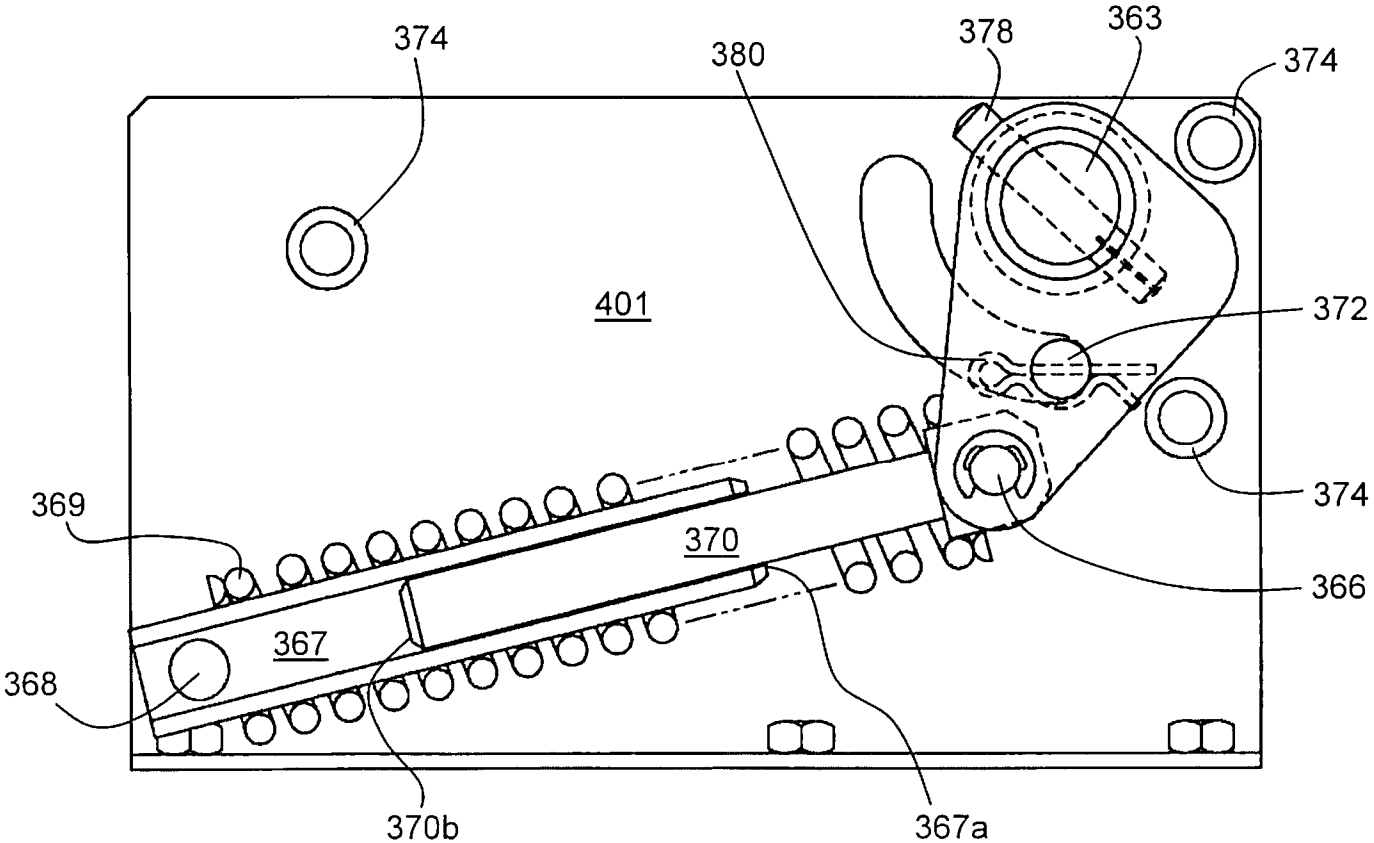
FIG. 17 is a front view of the preferred disconnect switch assembly operating mechanism shown in cut-away schematic form and constructed in accordance with the invention.
Figure 18A:
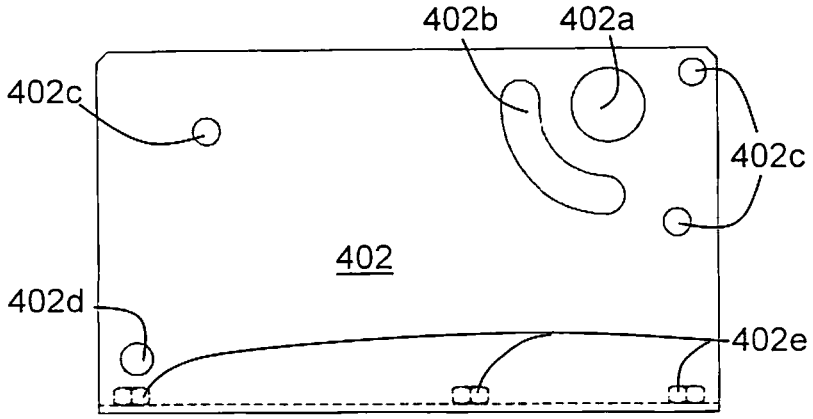
FIGS. 18A-T are illustrations of components of the disconnect switch assembly operating mechanism of FIG. 16.
Figure 18B:
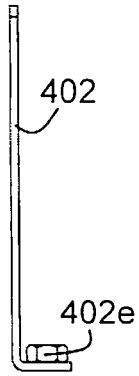
Figure 18C:
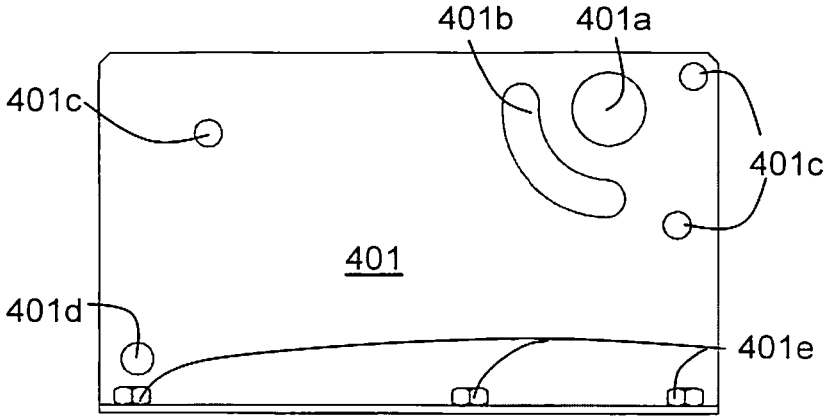
Figure 18D:
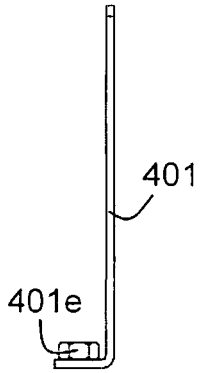
Figure 18E:
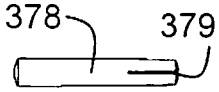
Figure 18F:
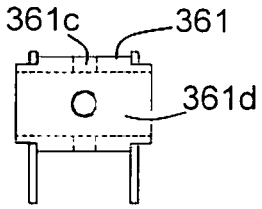
Figure 18G:
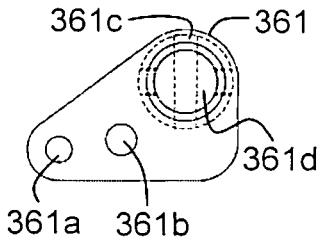
Figure 18H:
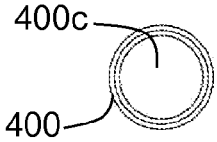
Figure 18I:
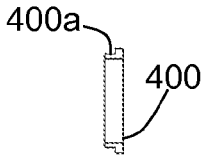
Figure 18J:
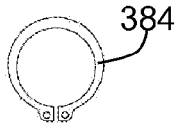
Figure 18K:
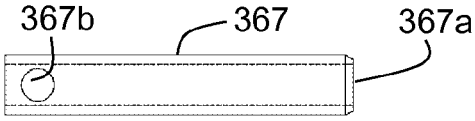
Figure 18T:
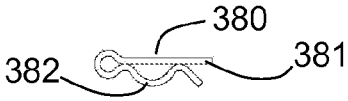
Figure 19:
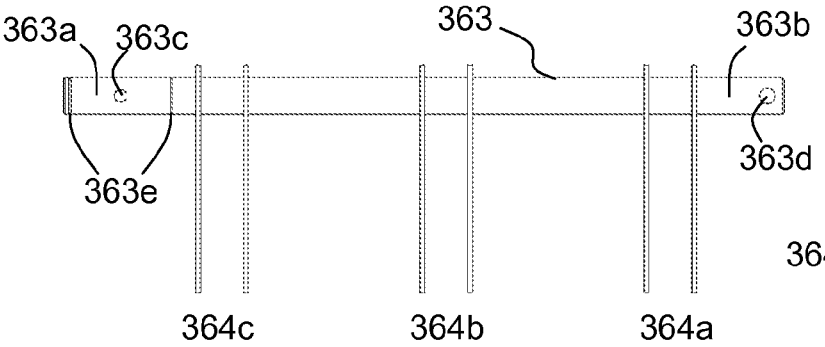
FIG. 19 is a front view of the drive shaft for the disconnect switch assembly.
Figure 20:
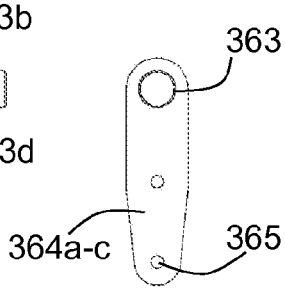
FIG. 20 is a side view of FIG. 19.

FIG. 16 is a side view of disconnect switch assembly operating mechanism 350. FIG. 17 is an internal view of operating mechanism 350. FIGS. 18*a* through 18T illustrate the components of the operating mechanism 350. FIGS. 19 and 20 are front and side views, respectively, of disconnect switch assembly drive shaft 363.

Figure 18L:
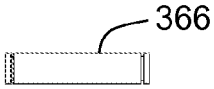
Figure 18M:
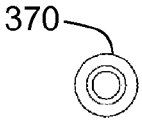
Figure 18N:
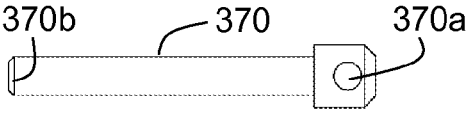
Figure 18O:
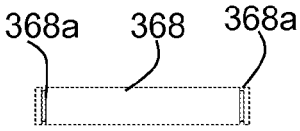
Figure 18P:
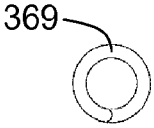
Figure 18Q:
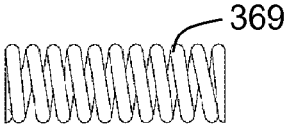

As illustrated in FIG. 16, pin 366 (FIG. 18L) is inserted through spring rod hole 370*a* (FIG. 18N), clevis holes 361*a* (FIG. 18G), and fastened to clevis 361 with retaining washers 391 at grooves 366*a* (FIG. 18L). End 370*b* (FIG. 18N) of spring rod 370 is inserted into spring tube 367 (FIG. 18J) through opening 367*a*. Spring 369 (FIG. 18Q) is fitted over spring tube 367 and pin 368 (FIG. 18O) is inserted through holes 367*b*. Pin 368 is inserted into hole 401*d* of frame 401 (FIGS. 18C,D) and hole 402*d* of frame 402 (FIGS. 18A,B) and fastened with retaining washers 391 at grooves 368*a* (FIG. 18O).

Flanged spacers 400 (FIG. 18H) are fitted onto drive shaft 363 (FIG. 19) and at both ends of clevis 361 with the flanged ends butting against the ends of clevis 361. End 400*a* of flanged spacers 400 (FIG. 18I) is inserted into hole 401*a* of frame 401 (FIG. 18C) and hole 402*a* of frame 402 (FIG. 18A). Openings 400*c* of flanged spacers 400 (FIG. 18H) are aligned with opening 361*d* of clevis 361 (FIG. 18G). End 363*a* of drive shaft 363 (FIG. 19) is fitted through retaining ring 384 (FIG. 18J), opening 400*c* in frame 402 (FIG. 18A), clevis shaft opening 361*d* of clevis 361 (FIG. 18G) and openings 400*c* in frame 401 (FIG. 18C) and fastened with retaining rings 384 (FIG. 18J) at grooves 363*e* (FIG. 19). Holes 361*c* (FIG. 18F) and hole 363*c* (FIG. 19) are aligned, and tapered pin 378 (FIG. 18E) is inserted slit end 379 first.

Figure 18R:
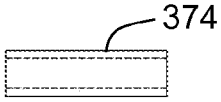

Frames 401 and 402 are held a desired distance apart by spacer tubes 374. The openings of spacer tubes 374 (FIG. 18R) are aligned with holes 401*c* of frame 401 (FIGS. 18C,D) and holes 402*c* of frame 402 (FIGS. 18A,B). Bolts are inserted through holes 401*c*, spacer tubes 374, and 402*c* and fastened with lock washers and nuts.

Figure 18S:
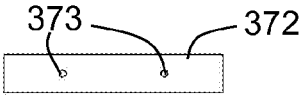

Guide rod 372 controls the degree of movement of the clevis 361. Guide rod 372 (FIG. 18S) is inserted through slot 401*b* of frame 401 (FIG. 18C), holes 361*b* of clevis 361, and slot 402*b* of frame 402 (FIG. 18A). Holes 373 of guide rod 372 (FIG. 18S) are positioned between the arms of clevis 361. Straight end 381 of retaining pins 380 (FIG. 18T) are inserted through holes 373 until section 382 of pins 380 surrounds guide rod 372.

Figure 43:
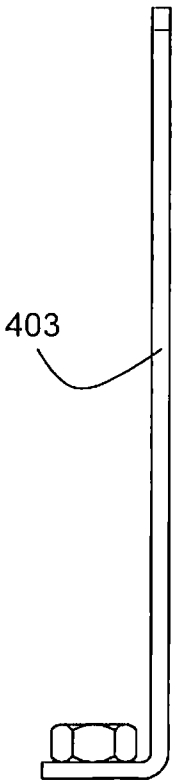
FIG. 43 is a side elevation view of FIG. 42.
Figure 42:
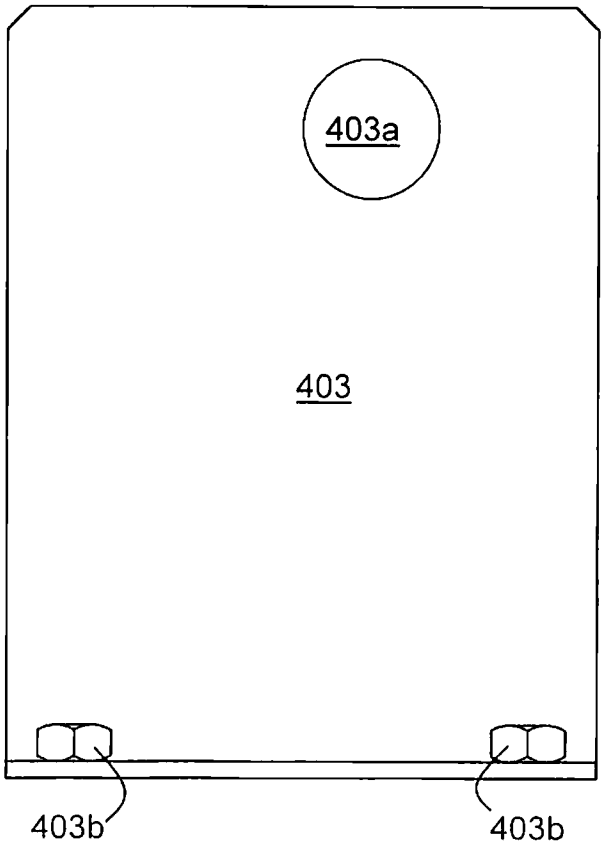
FIG. 42 is a front elevation view of a preferred mounting frame.

Referring to FIGS. 11, 42, and 43, end 363*b* of driveshaft 363 is fitted through hole 403*a* of frame 403 and frames 401, 402, and 403 are fastened to bottom 13 through mounting nuts 401*e*, 402*e*, and 403*b*, respectively.

As illustrated in FIGS. 6, 11, 21, 40A, and 40C, each operating mechanism 150*a* is bolted to support stand 410 through mounting nuts 201*h* and 201*i* at points 411*a* and 202*h* and 202*i* at points 411*b*. Operating mechanism 150*b* is bolted to support stand 410 through mounting nuts 201*h* and 201*i* at points 412*a* and 202*h* and 202*i* at points 412*b*. Operating mechanism 150*c* is bolted to support stand 410 through mounting nuts 201*h* and 201*i* at points 413*a* and 202*h* and 202*i* at points 413*b*.

Figure 22:
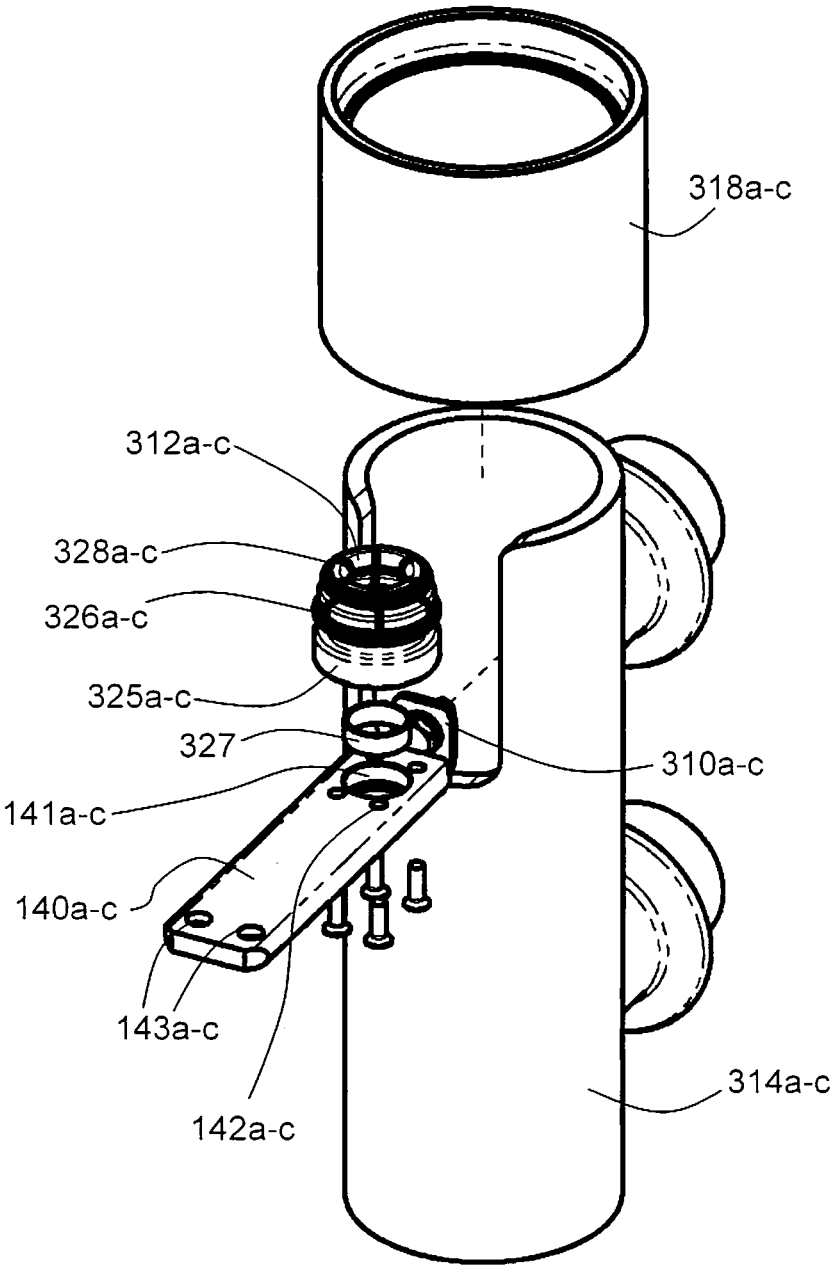
FIG. 22 illustrates an explosion view of the preferred disconnect switch insulating shield with bottom contact and connection bus.

As illustrated in FIGS. 6 and 22, L-bracket 310*a* is bolted through hole 311*a* to insulating shield 314*a* at point 313*a*. Connector 325*a-c* are similarly shaped as connector 320*a-c*, except shorter and wider in diameter. The large end of bottom contact 312*a* clasps onto the small end of connector 325*a*. Spring 326 is placed onto bottom contact 312*a* to hold it firmly onto connector 325*a*. Spacer 327 is placed into a small groove inside the small end of bottom contact 312*a*. Spring 328 is placed around the small end of bottom contact 312*a*. Bolts are inserted through support holes (not shown) in L-bracket 310*a* through holes 142*a* of connection bus 140*a*, and into holes at the bottom of connector 325*a*. Similarly, L-bracket 310*b* is bolted through hole 311*b* to insulating shield 314*b* at point 313*b*. The large end of bottom contact 312*b* clasps onto the small end of connector 325*b*. Spring 326 is placed onto bottom contact 312*b* to hold it firmly onto connector 325*b*. Spacer 327 is placed into a small groove inside the small end of bottom contact 312*b*. Spring 328 is placed around the small end of bottom contact 312*b*. Bolts are inserted through support holes (not shown) in L-bracket 310*b* through holes 142*b* of connection bus 140*b*, and into holes at the bottom of connector 325*b*. Likewise, L-bracket 310*c* is bolted through hole 311*c* to insulating shield 314*c* at point 313*c*. The large end of bottom contact 312*c* clasps onto the small end of connector 325*c*. Spring 326 is placed onto bottom contact 312*c* to hold it firmly onto connector 325*c*. Spacer 327 is placed into a small groove inside the small end of bottom contact 312*c*. Spring 328 is placed around the small end of bottom contact 312*c*. Bolts are inserted vertically through support holes (not shown) in L-bracket 310*c* through holes 142*c* of connection bus 140*c*, and into holes at the bottom of connector 325*c*.

As illustrated in FIGS. 4, 6 and 8, a gasket 319 is placed around the small end of each push-pull insulator 316. Contact rod 308*a* is threaded into the top side of push-pull insulator 316*a* and clevis-shaped connector 330*a* is bolted to the bottom side of push-pull insulator 316*a*. A peg 329 is inserted and fastened to connector 330*a* and rod 332*a* through arm holes 331 and 333, respectively. Similarly, contact rod 308*b* is threaded into the top side of push-pull insulator 316*b* and clevis-shaped connector 330*b* is bolted to the bottom side of push-pull insulator 316*b*. A peg 329 is inserted and fastened to connector 330*b* and rod 332*b* through arm holes 331 and 333, respectively. Contact rod 308*c* is threaded into the top side of push-pull insulator 316*c* and clevis-shaped connector 330*c* is bolted to the bottom side of push-pull insulator 316*c*. A peg 329 is inserted and fastened to connector 330*c* and rod 332*c* through arm holes 331 and 333, respectively. Contact rod 308*a* is inserted into insulating shield 314*a* and through bottom contact 312*a*. Contact rod 308*b* is inserted into bottom contact 312*b* and insulating shield 314*b*. Contact rod 308*c* is inserted into bottom contact 312*c*.

Figure 21:
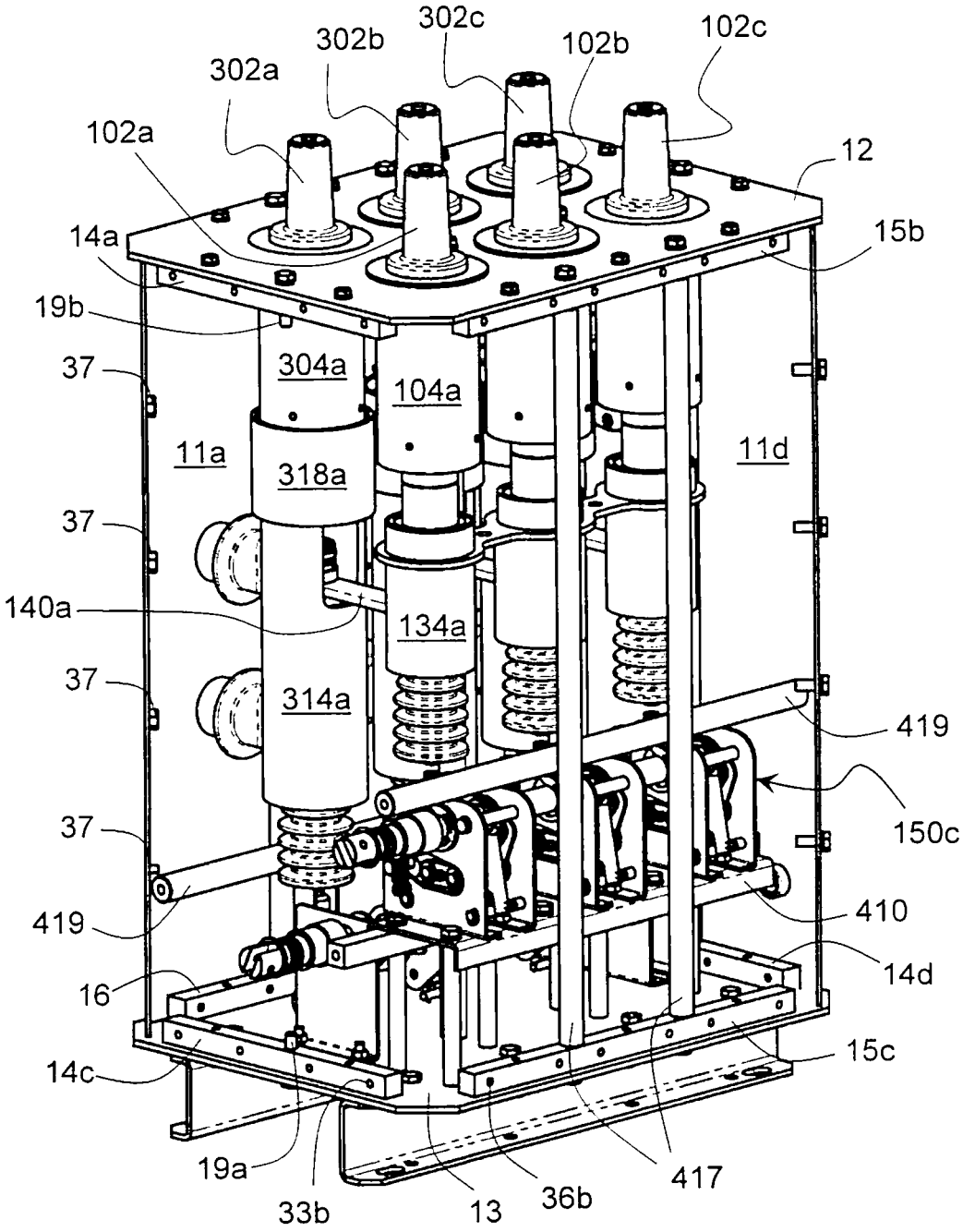
FIG. 21 is a right front perspective of the vacuum interrupter switch assembly with the front and right side panels removed.
Figure 23:
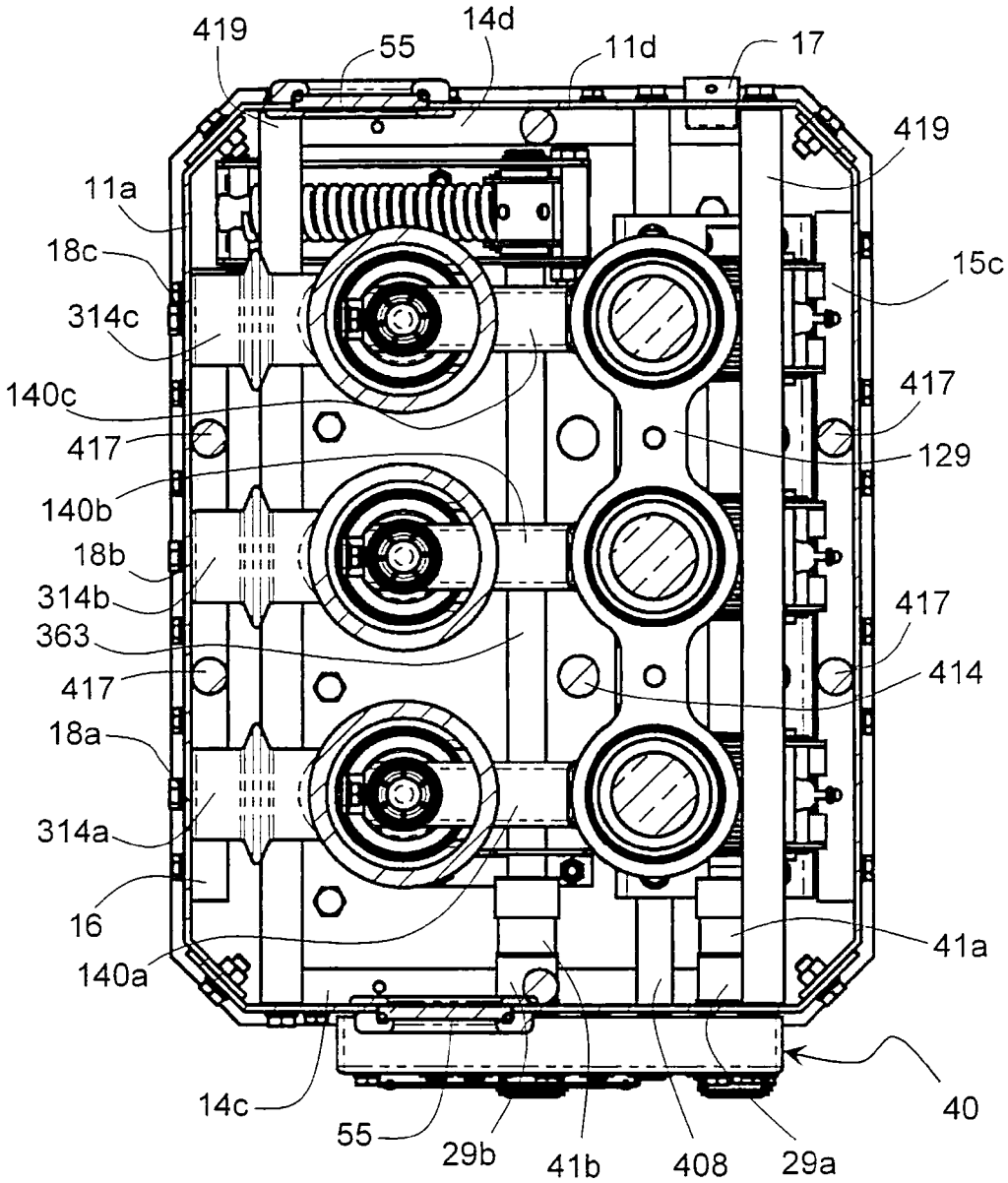
FIG. 23 is a cut-away top view of the preferred vacuum interrupter switch assembly illustrating the preferred internal layout of the disconnect switch assembly components.

Referring to FIGS. 6, 21, and 23, tank side 11*a* is bolted to support bar 15*a* and to support bar 16. Transparent cylinder 318*a* is fitted on top of the slotted end for insulating shield 314*a*. The top end of transparent cylinder 318*a* is fitted to the bottom end of insulating shield 304*a* and insulating shield 314*a* is bolted to tank side 11*a* at bolting points 18*a*. Similarly, transparent cylinder 318*b* is fitted on top of the slotted end for insulating shield 314*b*. The top end of transparent cylinder 318*b* is fitted to the bottom end of insulating shield 304*b* and insulating shield 314*b* is bolted to tank side 11*a* behind insulating shield 314*a* and generally parallel thereto at bolting points 18*b*. Likewise, transparent cylinder 318*c* is fitted on top of the slotted end for insulating shield 314*c*. The top end of transparent cylinder 318*c* is fitted to the bottom end of insulating shield 304*c* and insulating shield 314*c* is bolted to tank side 11*a* behind insulating shield 314*b* and generally parallel thereto at bolting points 18*c*.

As illustrated in FIGS. 4, 6, and 19, a peg 329 is inserted and fastened to rod 332*a* and drive shaft lever arms 364*a* through arm holes 334 and 365, respectively. A peg 329 is inserted and fastened to rod 332*b* and drive shaft lever arms 364*b* through arm holes 334 and 365, respectively. A peg 329 is inserted and fastened to rod 332*c* and drive shaft lever arms 364*c* through arm holes 334 and 365, respectively.

When properly assembled, and as best illustrated in FIGS. 4, 6, and 8, turning drive shaft 363 clockwise will move contact rods 308*a-c* through bottom contacts 312*a-c*, up through guide 305*a-c* and into top contacts 306*a-c*. This is referred to as the closed position. Top contact 306*a* will be electrically coupled to bottom contact 312*a* through contact rod 308*a*. Top contact 306*b* will be electrically coupled to bottom contact 312*b* through contact rod 308*b*. Top contact 306*c* will be electrically coupled to bottom contact 312*c* through contact rod 308*c*. Contact rods 308*a-c* can be seen through transparent insulating shields 318*a-c* and viewing windows 55. From the closed position, turning drive shaft 363 counterclockwise will move contact rods 308*a-c* out of top contacts 306*a-c*, through guides 305*a-c*, and down into bottom contacts 312*a-c* as illustrated in FIG. 8. This is the open position. Top contacts 306*a-c* are not electrically coupled to bottom contacts 312*a-c* and contact rods 308*a-c* are not visible inside transparent insulating shields 318*a-c*. As best illustrated in FIG. 6, connection bus 140*a* is bolted to bus connector 110*a* (FIG. 13) through holes 143 and holes 107, respectively. Connection bus 140*b* is bolted to bus connector 110*b* through holes 143 and holes 107, respectively, behind connection bus 140*a* and generally parallel thereto. Connection bus 140*c* is bolted to bus connector 110*c* through holes 143 and holes 107, respectively, behind connection bus 140*b* and generally parallel thereto.

Referring to FIGS. 5, 11, 21 and 24, two long cylindrical spacer rods 414 are bolted onto bottom 13 at points 415 and extend vertically upwards to cover 12 where they are bolted at points 416. Two each long cylindrical spacer rods 417 are bolted onto support bars 15*c* and 16 on bottom 13 and extend vertically upwards to support bars 15*a* and 15*b* on cover 12. Two long cylindrical spacer rods 418 are bolted onto support bars 14*c* and 14*d* on bottom 13 and extend vertically upwards to support bars 14*a* and 14*b* on cover 12.

As best illustrated in FIGS. 1, 9, and 23, a rubber cushion 52 is fitted into hole 62 of the tank's front side 11*b*. A window 55 with an O-ring 56 fitted along the edge is placed over hole 62 of tank side 11*b*. Window holder 57 is placed over window 55 and O-ring 56 from the outside of tank side 11*b* and window backplate 58 is placed over hole 62 from the inside of tank side 11*b*. Window backplate 58 is bolted through holes 58*a* and 59 to window holder 57 at threaded holes 57*a* (not shown). The same method is used to place a window 55 onto tank side 11*d* as shown in FIGS. 3 and 24.

It may now be appreciated that the viewing windows 55 (FIGS. 1-3) allow an operator to look inside vacuum interrupter switch assembly 5 to see whether or not disconnect switch assemblies 300*a-c* are in the open or closed position. In the closed position, contact rods 308*a-c* will be seen inside transparent insulating shields 318*a-c*. In the open position, contact rods 308*a-c* will not be seen inside transparent insulating shields 318*a-c*.

Figure 24:
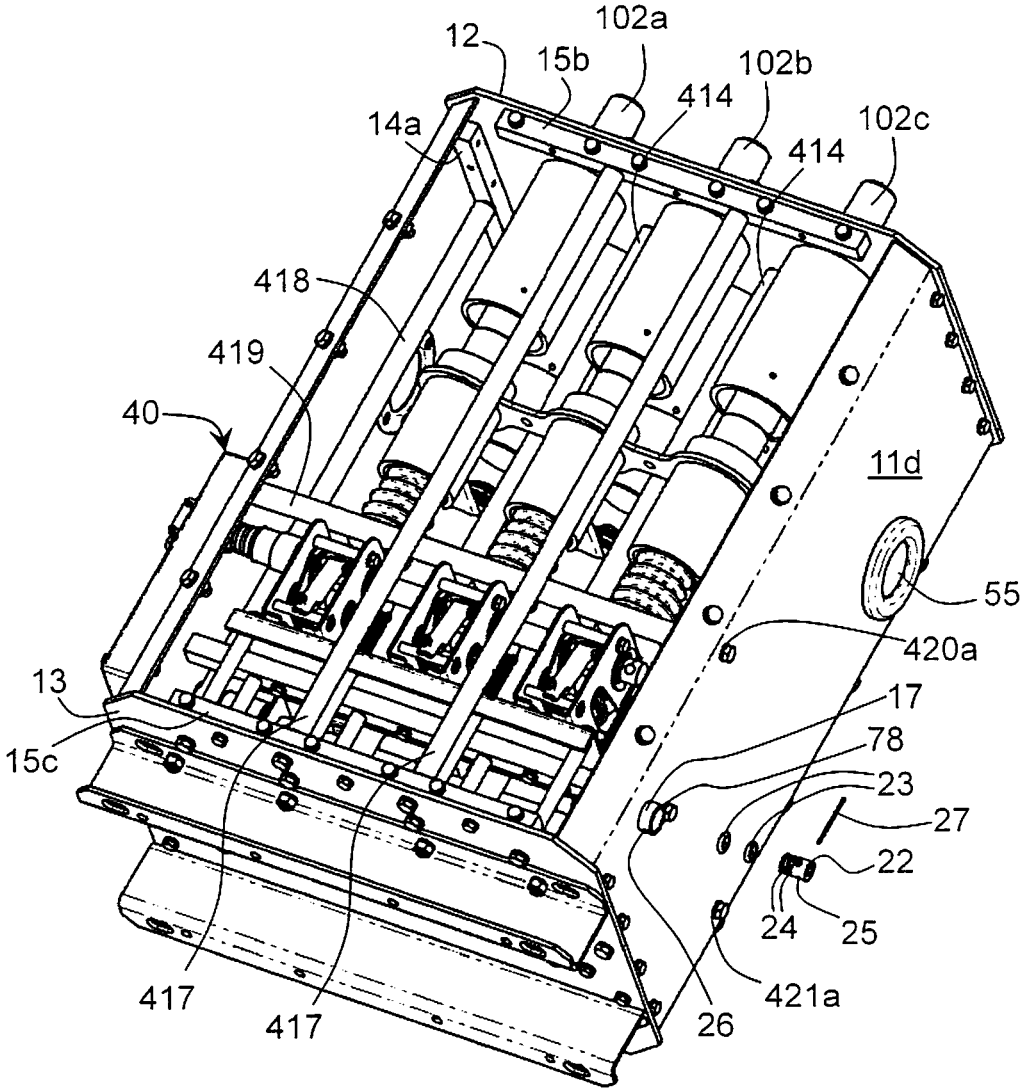
FIG. 24 is a lower right side perspective view of the preferred vacuum interrupter switch assembly illustrating the preferred internal layout of components.

As illustrated in FIG. 24, O-rings 23 are fitted into grooves 24 on gas vent plug 22 and inserted into gas vent 17. Holes 26 of gas vent 17 and holes 25 of gas vent plug 22 are aligned and cotter pin 27 is inserted.

Interlocking Control Assembly 40

Proper integration of a visible disconnect switch should preferably include proper procedures for opening and closing the vacuum interrupter switch assembly. The interlocking control assembly preferably used herein ensures that correct procedures are taken to open and close the vacuum interrupter switch assembly 5. Interlocking control assembly 40 accordingly prevents the internal disconnect switch assemblies 100*a-c* from opening or closing unless the vacuum interrupter bottle switches 108*a-c* are open.

Figure 25:
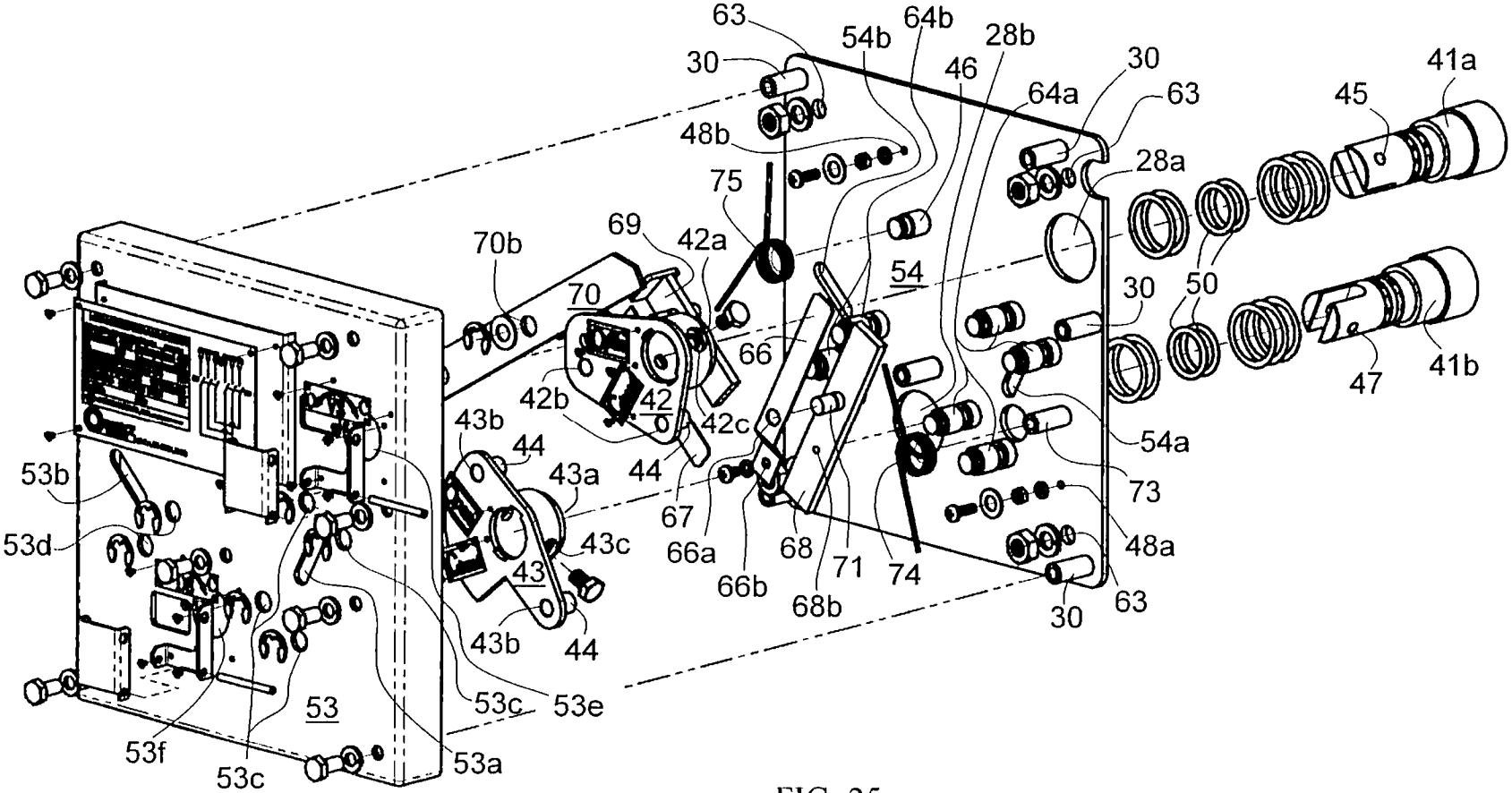
FIG. 25 is an expanded view of the preferred interlocking control assembly.
Figure 26:
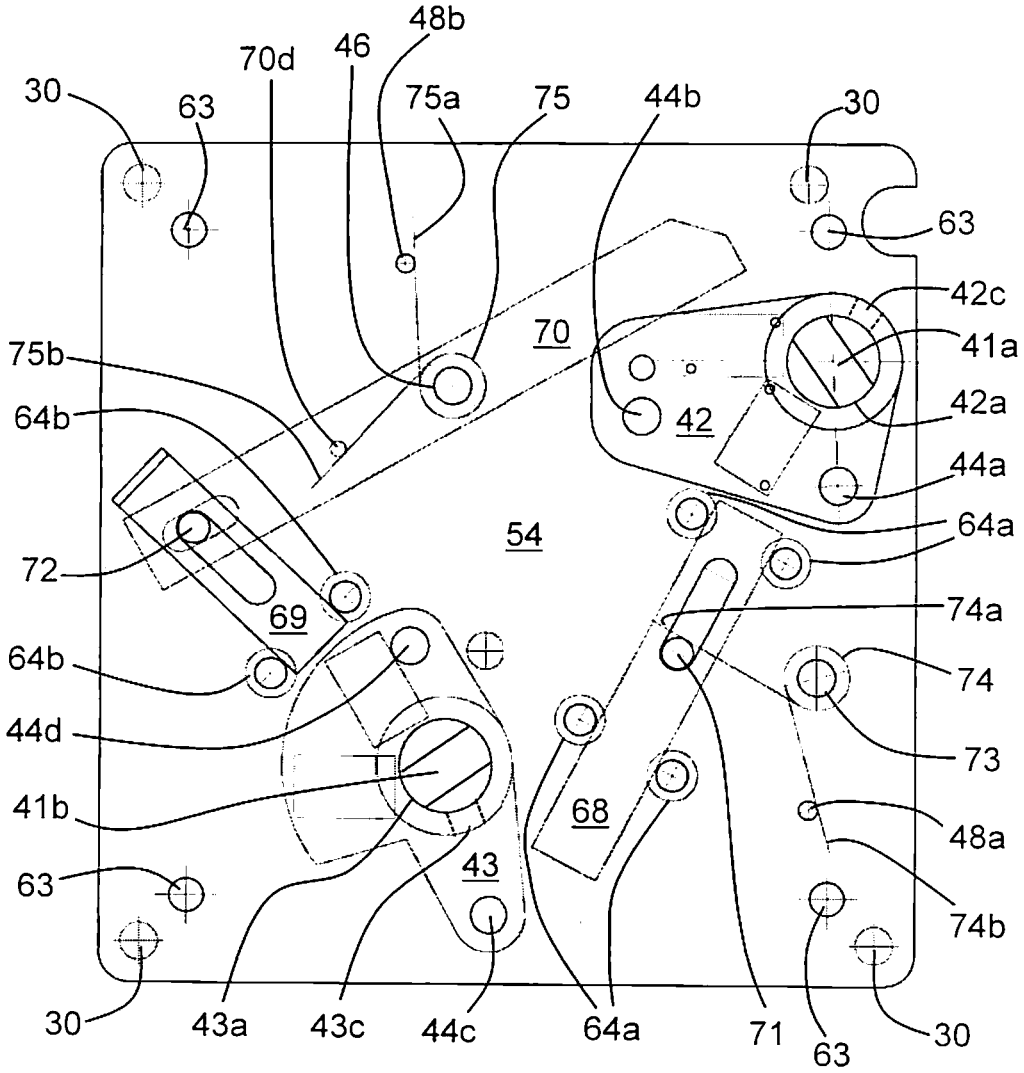
FIG. 26 is a cut-away view of the preferred interlocking control assembly illustrating the preferred internal layout of some components.

FIG. 25 illustrates an expanded view of the preferred interlocking control assembly 40. Threaded cover spacers 30 and spacer guides 64*a* and 64*b* are welded into place on backplate 54. Referring to FIGS. 9, 25, and 26, control assembly backplate 54 is bolted to front side 11*b* through holes 63 and 31, respectively. O-rings 50 are fitted into grooves 51 of control shafts 41*a* and 41*b*. Control arm 42 has studs 44*a* and 44*b* inserted in holes 42*b*. Control arm 43 has studs 44*c* and 44*d* inserted in holes 43*b*.

Referring to FIGS. 1, 2, 9, 23 and 25, the slotted end of control shaft 41*a* for vacuum interrupter bottle switch assemblies 100*a-c* is inserted through control shaft well 29*a* of front side 11*b*, through hole 28*a* of backplate 54, and into control arm 42 at opening 42*a*. Hole 45 of control shaft 41*a* is aligned with hole 42*c* of control arm 42 and bolted together. The slotted end of control shaft 41*b* for disconnect switch assemblies 300*a-c* is inserted through its control shaft well 29*b* of front side 11*b*, through hole 28*b* of backplate 54, and into control arm 43 at opening 43*a*. Hole 47 of control shaft 41*b* is aligned with hole 43*c* of control arm 43 and bolted together. Spring 74 is placed around threaded spacer 73. Spring 75 is placed around spacer 46.

Rod 71 is inserted through the large hole of blocker guide bar 68 and fastened near the middle with retaining washers. Blocker 66 is screwed to blocker guide bar 68 through holes 66*b* and 68*b*, respectively, with rod 71 being inserted through hole 66*a* of blocker 66.

Pivot rod 72 is inserted through hole 69*a* of blocker guide bar 69, through slot hole 70*b* of toggle bar 70, and through hole 67*a* of blocker 67 and fastened near the middle with retaining washers. A peg 70*d* is installed into peg hole 70*c* with peg 70*d* extending inwards.

Toggle bar 70 is placed onto spacer 46 through pivot hole 70*a* and fastened with a retaining washer. Guide bar 69 is placed between spacer guides 64*b* and end 72*b* of pivot rod 72 is inserted into slot 54*b* of backplate 54. After installation, the flat portion of control arm 43 will be between blocker 67 and guide bar 69. The back end of rod 71 is inserted into slot 54*a* of backplate 54 and guide bar 68 is placed between spacer guides 64*a*. After installation, the flat portion of control arm 42 will be between blocker 66 and guide bar 68.

As best illustrated in FIG. 25, a screw and washer is screwed into holes 48*a* and 48*b* on backplate 54. As best illustrated in FIG. 26, spring end 74*a* pushes against rod 71. Spring end 74*b* pushes against the screw at hole 48*a* and held down by the washer. Spring end 75*a* pushes against the screw at hole 48*b* and held down by the washer. Spring end 75*b* pushes against peg 70*d* of toggle bar 70.

Figure 44:
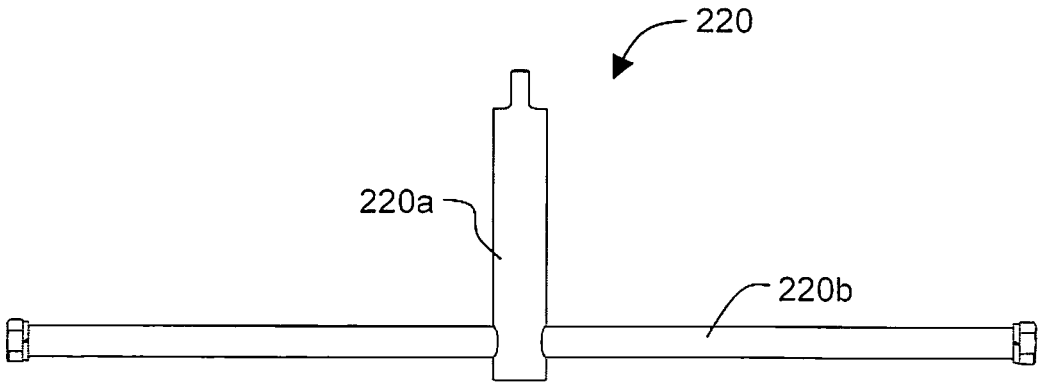
FIG. 44 is a top plan view of a preferred operating handle.
Figure 45:
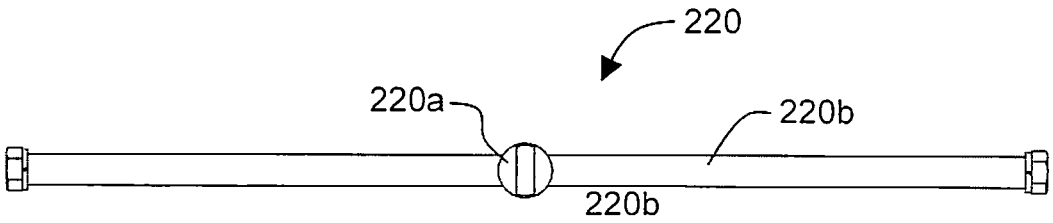
FIG. 45 is a front elevation view of the handle of FIG. 44.
Figure 46:
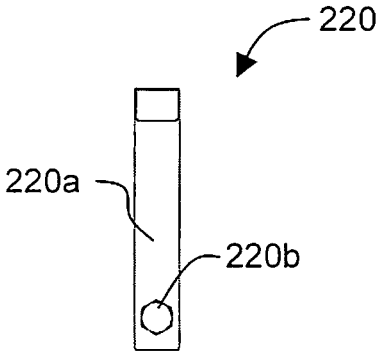
FIG. 46 is a side elevation view of the handle of FIG. 44.

When properly assembled, FIG. 26 illustrates the positions of the interlocking control assembly 40 components when the disconnect switch assemblies 300*a-c* are in the closed position and the vacuum interrupter bottle switch assemblies 100*a-c* in the open position. As shown, control arm 42 can only rotate clockwise and control arm 43 can only rotate counterclockwise. When control arm 42 is rotated clockwise, stud 44*b* will push toggle bar 70 so that it rotates counterclockwise around spacer 46 and pushes guide bar 69 downwards towards control arm 43 guided by spacers 64*b*. Once the rotation is completed, blocker 67 covers hole 43*a* of control arm 43 to prevent access with handle 220 (FIG. 44-46). Guide bar 69 is also positioned to prevent control arm 43 from rotating counterclockwise by blocking stud 44*d* of control arm 43. From this point, control arm 42 must be rotated counterclockwise first before control arm 43 can rotate counterclockwise. After control arm 42 is rotated counterclockwise, spring end 75*b* pushes against peg 70*d* so that toggle bar 70 rotates clockwise and guide bar 69 is pulled upwards to allow movement for control arm 43.

When control arm 43 is rotated counterclockwise, stud 44*c* of control arm 43 will push guide bar 68 upwards towards control arm 42 guided by guide spacers 64*a*. Once the rotation is completed, blocker 66 covers hole 42*a* of control arm 42 to prevent access with handle 220. Guide bar 68 is also positioned to prevent control arm 42 from rotating clockwise by blocking stud 44*a* of control arm 42. From this point, control arm 43 must be rotated clockwise first before control arm 42 can rotate clockwise. After control arm 43 is rotated clockwise, spring end 74*a* pushes against pivot rod 71 so that guide bar 68 is pulled downwards to allow movement for control arm 42.

As best illustrated in FIGS. 6 and 23, tank side 11*c* is bolted to support bars 15*b* and 15*c* through threaded holes. Control shafts 41*a* and 41*b* are aligned and fitted over ends 60*d* of drive shaft 60 and end 363*b* of drive shaft 363, respectively. Tank side 11*b* is bolted to support bars 14*a* and 14*c* through threaded holes. Tank side 11*d* is bolted to support bars 14*b* and 14*d* through threaded holes. Tank sides 11*a*, 11*b*, 11*c*, and 11*d* are bolted together at bolting nuts 37. As best illustrated in FIG. 5, rectangular support bar 408 is bolted to tank side 11*b* and 11*d* at points 79 and 78, respectively. As best illustrated in FIG. 24, cylindrical rods 419 are bolted to tank side 11*d* at points 420*a* and 420*b* and to corresponding points on tank side 11*b*.

Interlocking control assembly cover 53 is aligned and secured to threaded cover spacers 30 with washers and bolts. As illustrated in FIG. 9, the front end of rod 71 will extend into slot 53*a* and the front end of pivot rod 72 will extend through slot 53*b* of cover 53. The front ends of spacer guides 64*a* and 64*b* will extend out of holes 53*c* and 53*d*, respectively, and fastened with retaining washers. The slotted openings for control shafts 41*a* and 41*b* can be accessed through holes 53*e* and 53*f*, respectively, of cover 53.

Vacuum interrupter switch 5 is operated with handle 220 (FIGS. 44-46) by inserting the slotted end of handle shaft

220*a* into the slotted openings of either control shafts 41*a* or 41*b* and turning clockwise or counterclockwise.

The specific components illustrated in the drawings and described in the specification are presently preferred components, and there is no intention to limit the scope of the invention to an assembly using these specific components to achieve the intended result. It is recognized that those skilled in the art may be able to change or modify the specifically described hardware, and that various changes, substitutions and alterations can be made herein without departing from the spirit and scope of the invention as defined by appended claims. It is accordingly intended that the claims be interpreted as broadly as possible in light of the prior art, and that the full advantage of the Doctrine of Equivalents be employed in such interpretation.

We claim:

1. A vacuum interrupter switch assembly comprising:

(a) an outer case having at least one window;

(b) a plurality of internal disconnect switch assemblies, each internal disconnect switch assembly including a power bushing, first and second electrical contacts spatially separated from each other, one of said contacts being electrically connected to the power bushing, at least a portion of the region between the contacts being viewable through the window a contact rod movable between the first and second contacts to selectively electrically couple and decouple the first and second contacts, a visually transparent insulating shield extending along and around at least a portion of the region between the first and second contacts so that the contact rod is sufficiently viewable through the insulating shield and window only when the first and second contacts are electrically coupled, thereby visually signifying whether the contact rod is electrically coupling or not electrically coupling the first and second contacts, the control rods of each internal disconnect switch assembly being connected so that the plurality of disconnect switch control rods move in unison;

(c) a plurality of vacuum interrupter bottle switch assemblies, each including a power bushing, a substantially stationary electrical contact electrically connected to the power bushing, a movable electrical contact movable between the first and second positions to selectively electrically couple to and electrically decouple from the substantially stationary contact to thereby respectively close and open-circuit the bottle switch assembly, the movable electrical contacts of each vacuum interrupter bottle switch assembly being mechanically linked so that the plurality of movable electrical contacts move in unison;

each of the vacuum interrupter bottle switch assemblies being connected in electrical series with a corresponding one of the internal disconnect switch assemblies;

the plurality of vacuum interrupter bottle switch assemblies being mechanically coupled to the plurality of internal disconnect switch assemblies so that electrically coupled disconnect switch contacts cannot become electrically decoupled or become electrically coupled unless the bottle switch contacts are not electrically coupled.

2. The vacuum interrupter switch assembly of claim 1 wherein the case is dimensioned to fit within an access hole of substantially 30 inches in diameter.

3. The vacuum interrupter switch assembly of claim 1 wherein the interior of the case is substantially free of oil and $SF_6$ gas.

4. The vacuum interrupter switch assembly of claim 1 including a first shaft coupled to the interrupter bottle switches' movable contacts and having a manually engagable end portion accessible from the exterior of the case for manually electrically coupling and electrically decoupling the interrupter bottle switches' contacts;

a second shaft coupled to internal disconnect switch assembly control rods and having a manually engagable end portion accessible from the exterior of the case for manually electrically coupling and electrically decoupling the first and second contacts of the internal disconnect switch assemblies;

a blocking member coupled to the first shaft, and responsive to the position thereof to block engagement of the second shaft's manually engagable end portion when the interrupter bottle switch assemblies are closed.

5. The vacuum interrupter switch assembly of claim 4 wherein the interior of the case is substantially free of oil and $SF_6$ gas.

6. The vacuum interrupter switch assembly of claim 5 wherein the case is dimensioned to fit within an access hole of substantially 30 inches in diameter.

* * * * *